US006377765B1

(12) United States Patent
Shishido et al.

(10) Patent No.: US 6,377,765 B1
(45) Date of Patent: Apr. 23, 2002

(54) MEANS FOR INDEPENDENTLY CHANGING A LATENT IMAGE CARRIER UNIT AND A DEVELOPING UNIT IN AN IMAGE FORMING UNIT

(75) Inventors: Hisao Shishido; Nobuo Kuwabara; Tomohiro Hikita, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/589,175

(22) Filed: Jun. 8, 2000

(30) Foreign Application Priority Data

Oct. 20, 1999 (JP) ..... 11-297977

(51) Int. Cl.[7] ..... G03G 15/00; G03G 21/00

(52) U.S. Cl. ..... 399/113; 222/DIG. 1; 399/111; 399/358; 399/359

(58) Field of Search ..... 399/113, 119, 399/120, 262, 263, 258, 343, 358, 359

(56) References Cited

U.S. PATENT DOCUMENTS

| | | | | |
|---|---|---|---|---|
| 4,894,688 A | * | 1/1990 | Taniguchi et al. | 399/119 |
| 4,941,022 A | * | 7/1990 | Ohmura et al. | 399/120 |
| 5,079,593 A | * | 1/1992 | Satoh et al. | 399/119 |
| 5,369,474 A | | 11/1994 | Yamada | |
| 5,852,757 A | | 12/1998 | Tooda et al. | |

FOREIGN PATENT DOCUMENTS

| | | |
|---|---|---|
| JP | 62-115179 | 5/1987 |
| JP | 4204970 | 7/1992 |
| JP | 6083172 | 3/1994 |
| JP | 9062074 | 3/1997 |

* cited by examiner

*Primary Examiner*—Arthur T. Grimley
*Assistant Examiner*—Hoang Ngo
(74) *Attorney, Agent, or Firm*—Armstrong, Westerman, & Hattori, LLP

(57) ABSTRACT

Image forming unit has a photosensitive drum unit and a developing unit. The photosensitive drum unit has drum shafts extending outward from opposite sides thereof. The developing unit has a through-hole and a drum shaft mounting groove for receiving the drum shafts, and developing unit rotary shafts extending outward from opposite sides thereof. An engagement lever and a toner returning cylinder are provided in the photosensitive drum unit, and a shutter is provided in the developing unit. The toner returning cylinder and the shutter are disposed between the waste toner tank of the photosensitive drum unit and the toner returning pipe of the developing unit so that they are detachable and separable from each other. Further, a mechanism is provided for pressing the developing roller onto the photosensitive drum when the photosensitive drum unit is mounted to the developing unit or when the photosensitive roller is driven.

24 Claims, 24 Drawing Sheets

MEANS FOR INDEPENDENTLY CHANGING A LATENT IMAGE CARRIER UNIT AND A DEVELOPING UNIT IN AN IMAGE FORMING UNIT

BACKGROUND OF THE INVENTION

1. Field of the Invention

The present invention relates to an image forming unit, a latent image carrier unit, a developing unit and an image forming apparatus. In particular, the present invention relates to an image forming unit, a latent image carrier unit, a developing unit and an image forming apparatus which are characterized by a mechanism for enabling the user to replace the latent image carrier unit (or photosensitive drum unit) and the developing unit independently of each other and a mechanism for pressing a developing roller of the developing unit onto a photosensitive drum of the photosensitive drum unit, operable following at least one of a mounting movement when the photosensitive drum unit is mounted to the developing unit and a driving movement in the image forming unit.

2. Description of the Related Art

The image forming apparatus of an electronic photographic recording system, such as a copier or a printer, has widely prevailed in office use due to its high operation speed, high resolution and low noise, and the market thereof has recently been widened even to a personal use in which a lower machine cost, a smaller machine size and/or a higher resolution image are required.

In the prior art printer of an electronic photographic recording system using a static latent and image forming process, a static latent image is formed on a uniformly charged surface of a photosensitive drum by exposing it to a laser optical system or an LED array system in accordance with image information.

Then, in a developing process, a visible toner image is developed by sticking charged toner onto the static latent image on the photosensitive drum by using a developing roller, and the toner image is then statically transferred to a recording medium by using a transfer device. Thereafter, the transferred visible image is fixed on the recording medium by heat, pressure or light, and the recording medium is discharged to a stacker.

In such a printer of an electronic photographic recording system, the toner not transferred but left on the surface of the photosensitive drum is removed therefrom by a cleaning blade, and returned to a toner box of the developing unit through a toner returning mechanism for repeated use. The printer of an electronic photographic recording system provided with such a toner returning mechanism will be described below with reference to FIGS. 20 and 21.

In FIG. 20, a structure of one example of the printer of an electronic photographic recording system with the prior art toner returning mechanism is conceptually illustrated, wherein a photosensitive drum unit 60 includes a photosensitive drum 61 and a cleaning unit 62 having a cleaning blade 63 arranged with the drum in a unit, and a developing unit 70 is detachably mounted to the photosensitive drum unit 60 to form an image forming unit which in turn is detachably mounted to a printer device 100.

The developing unit 70 is provided with a doctor blade 71, a developing roller 72 comprising a magnetic roller and a sleeve, agitators 73 and 74 and a toner chamber 75. A toner cartridge 83 is detachably mounted to the developing unit 70, for dispensing toner into the developing unit 70 through an opening provided in a cartridge support member 81.

In the image forming unit of such a structure, a toner returning mechanism 90 is provided to couple the cleaning unit 62 of the photosensitive drum unit 60 to the toner chamber 75 of the developing unit 70 for recycling the toner which is not transferred but is removed from the photosensitive drum 61 by the cleaning unit 62.

A corona charger 86 is arranged at the opening in the housing of the image forming unit, and a transfer device 87 is disposed beneath the photosensitive drum unit 60. An optical unit 88 such as an LED array is disposed downstream from the corona charger 86 in the sense of the rotational direction of the photosensitive drum.

In the above-mentioned printer of an electronic photographic recording system, after the photosensitive drum 61 is uniformly charged by the corona charger 86, a static latent image is formed on the surface thereof by a light from the optical unit 88 in accordance with image information or printing information, and conveyed to a developing zone as the photosensitive drum 61 rotates. In the developing zone, a toner layer on the developing roller 72 is attracted to the static latent image on the photosensitive drum 61 by static attraction to form a visible toner image which in turn is transferred to the recording medium by the transfer device 87 and then fixed by the fixing device 88. Finally, the recording medium 110 on which the visible image has been fixed is discharged to a stacker 101.

In this connection, the surface of the photosensitive drum 61 is cleaned by the cleaning blade 63 after the transfer, and the removed toner is received by a waste toner tank 64 of the cleaner unit 62. Thereafter, the surface of the photosensitive drum 61 is decharged by a decharging means (not shown) to resume the initial state.

The non-transferred waste toner is made to return from the cleaner unit 62 to the toner chamber 75 of the developing unit 70 through the toner returning mechanism 90.

FIG. 21 is a plan view of the above-mentioned toner returning mechanism 90 including a flexible tube 91 and a rotatable coil member 92 accommodated in the flexible tube 91. One end of the coil member 92 is connected to a helical gear 94 intermeshed with a helical gear 93 rotating in association with a coil member 76 provided in the waste toner tank 64 to return the waste toner in the waste toner tank 64 to the toner chamber 75 via the flexible tube 91.

In the printer of an electronic photographic recording system with the prior art toner returning mechanism 90, it is substantially impossible for the user to replace the photosensitive drum unit 60 and the developing unit 70 separately from each other although the developing unit is apparently detachable from the photosensitive drum unit 60, since the toner returning mechanism 90 is firmly connected to the photosensitive drum unit 60 and the developing unit 70.

In an example of a specification, for example, the developing unit is guaranteed to perform the printing of approximately ten thousand sheets, while the photosensitive drum unit is guaranteed to perform the printing of approximately fifty thousand sheets. In the printer of an electronic photographic recording system with the prior art toner returning mechanism, however, the image forming unit consisting of the photosensitive drum unit and the developing unit as described above must be replaced as a one-piece part, which means that the duration of replacement life of the image forming unit is necessarily matched with the developing unit having a shorter duration of replacement life, whereby it is impossible to effectively use the photosensitive drum.

In this regard, the duration of life of the developing unit is decided by that of the developing roller and/or an amount of toner contained therein, while the duration of life of the photosensitive drum unit is decided by that of the photosensitive drum.

A single component developing method using a non-magnetic developing agent, particularly in such a method of a contact developing system wherein the development is carried out by the contact of the photosensitive drum with the developing roller is believed advantageous for realizing the above-mentioned requirement for low cost, size reduction or high resolution image quality. However, printing defects, such as blur, are liable to occur in the above method if the photosensitive drum and the developing unit are detachably connected to each other so that the user is capable of replacing one of them with a fresh one, unless the photosensitive drum is assuredly in tight contact with the developing roller.

SUMMARY OF THE INVENTION

To solve such a problem, an object of the present invention is to provide an image forming unit in which a photosensitive drum unit and a developing unit are replaceable independently of each other by a user.

Also, another object of the present invention is to enable a user to independently replace the photosensitive drum unit or the developing unit from each other, and to assuredly bring them into tight contact with each other.

According to the present invention, an image forming unit comprises a latent image carrier unit and a developing unit detachably mounted to each other, characterized by an engagement mechanism for detachably engaging a waste toner receptacle provided in the latent image carrier unit with a toner returning mechanism provided in the developing unit, and an opening/closing mechanism for delivering the toner from the waste toner receptacle to the toner returning mechanism.

In this structure, it is possible for the user to replace the latent image carrier unit and the developing unit independently of each other so that the respective unit is effectively usable until the duration of the life thereof has lapsed. For example, a shutter may be provided as part of the opening/closing mechanism for delivering the toner into the toner returning mechanism.

Also, according to the present invention, an image forming unit is characterized by a pressing device operable following at least one of a mounting movement when the latent image carrier unit is mounted to the developing unit and a driving movement in the image forming unit for pressing a developing roller of the developing unit onto a latent image carrier of the latent image carrier unit.

In this structure, it is possible to assuredly bring the developing roller into tight contact with the latent image carrier irrespective of the positional accuracy of an image forming unit supporting mechanism provided in a main body of an image forming apparatus, whereby the generation of printing defects is avoidable.

Preferably, the pressing device comprises a lever opening/closing mechanism provided in the latent image carrier unit. By providing the lever opening/closing mechanism in the latent image carrier unit and engaging the same with an engagement means provided in the developing unit as described above, it is possible to easily press the developing roller onto the latent image carrier. Or, the pressing device comprises a lever opening/closing mechanism provided in the latent image carrier unit and a mechanism for rotating the developing roller by a drive force derived from the main body of the image forming apparatus. By providing the mechanism for rotating the developing roller driven by driving force derived from the main body of the image forming apparatus, together with the lever opening/closing mechanism as described above, to displace the developing roller toward the latent image carrier about a rotating shaft, it is possible to more assuredly press the developing roller onto the latent image carrier. Or, the pressing device comprises a lever opening/closing mechanism provided in the latent image carrier unit, a mechanism for rotating the developing unit driven by a drive force derived from the main body of the image forming apparatus, and a mechanism for rotating the image carrier driven by a drive force derived from the main body of the image forming apparatus. By providing the mechanism for rotating the image carrier driven by a drive force derived from the main body of the image forming apparatus, together with the lever opening/closing mechanism and the developing unit rotating mechanism, and by changing a torque thereof into a pressing force as described above, it is possible to more assuredly press the developing roller onto the latent image carrier in a follow-up manner.

Preferably, a projection is provided in the latent image carrier unit to be in contact with a projection provided in the developing unit when the latent image carrier rotates so that a force is generated due to a torque from the latent image carrier rotating mechanism, for pressing the developing unit onto the latent image carrier in a follow-up manner. As a mechanism for changing the torque of the latent image carrier to the pressing force, projections are preferably provided both in the latent image carrier unit and the developing unit, whereby a force pressing the developing unit onto the latent image carrier in a follow-up manner is assuredly generated even by such a simple structure.

Favorably, the lever opening/closing mechanism includes an engagement lever to be engaged with a slidable lever provided in the developing unit and connected to a spring member. By using the slidable lever connected to the spring member in the developing unit as a structure to be engaged with the engagement lever constituting the lever open/close mechanism, a stable pressing force is obtainable by the action of the spring member.

Preferably, a projection is provided in the latent image carrier unit to be engaged with a groove provided in a side wall of the developing unit so that a force pressing the developing unit onto the latent image carrier in a follow-up manner is obtained due to the torque accompanied with the opening/closing operation of the lever opening/closing mechanism. By providing the projection in the latent image carrier unit to be engaged with the groove provided in the side wall of the developing unit as described above, it is possible to generate a further follow-up pressing force due to the torque accompanied with the opening/closing operation of the lever-opening/closing mechanism, to result in a more reliable press-contact.

Preferably, the lever opening/closing mechanism provided in the latent image carrier unit is also used as an opening/closing mechanism for delivering the toner from the bottom of the waste toner receptacle into the toner returning mechanism provided in the developing unit. Thereby, an effective separation mechanism for the image forming unit having the toner returning mechanism is obtainable, which simplifies an overall structure.

Also, according to the present invention, a latent image carrier unit is provided, which is characterized in that a drive means for driving an opening/closing mechanism is provided for delivering the toner into the toner returning mechanism provided in the developing unit. By providing the driving mechanism for driving the opening/closing mechanism for delivering the toner into the toner returning mechanism provided in the developing unit, for example, a pressing member for rotating a shutter in association with the lever opening/closing mechanism, a latent image carrier unit is obtainable which is capable of being replaced as an independent part independently from the developing unit.

Also, according to the present invention, a latent image carrier unit is provided which is characterized in that a pressing device is provided for pressing the developing roller of the developing unit onto the latent image carrier of the latent image carrier unit. The pressing device is operable following at least one of a mounting movement when the latent image carrier unit is mounted to the developing unit and a driving movement in the image forming unit. By providing the pressing device, it is possible to simplify the pressing mechanism in the image forming unit of a contact development system.

Also, according to the present invention, the pressing device is constituted by a lever opening/closing mechanism including an engagement lever engaged with a slide lever connected to a spring member provided in the developing unit.

Also, according to the present invention, a developing unit is provided which is characterized in that, in the toner returning mechanism, an engagement mechanism is provided to be releasably engaged with the bottom of the waste toner receptacle provided in the latent image carrier unit, and an opening/closing mechanism is provided for delivering the toner into the toner returning mechanism from the bottom of the waste toner receptacle. By providing the engagement mechanism to be releasably engaged with the bottom of the waste toner receptacle provided in the latent image carrier unit and the opening/closing mechanism for delivering the toner into the toner returning mechanism from the bottom of the waste toner receptacle, it is possible to constitute the developing unit as an independent part to be replaced independently from the latent image carrier unit. In this regard, part of the opening/closing mechanism may be constituted by a shutter.

Also, according to the present invention, a developing unit is provided which is characterized in that a pressing device is provided in a manner similar to the above.

Also, according to the present invention, an image forming apparatus is provided which comprises an image forming unit wherein a latent image carrier unit and a developing unit are detachably mounted to each other is provided, characterized in that an engagement mechanism is provided for releasably engaging a waste toner receptacle provided in the latent image carrier unit with a toner returning mechanism provided in the developing unit, and an opening/closing mechanism is provided for delivering the toner from the bottom of the waste toner receptacle into the toner returning mechanism. By this structure, it is possible to constitute an image forming apparatus from which the developing unit and the latent image carrier unit are replaceable independently from each other. Part of the opening/closing mechanism for delivering the toner into the toner returning mechanism may be constituted by a shuffer.

Also, according to the present invention, an image forming apparatus is provided which comprises an image forming unit wherein a latent image carrier unit and a developing unit are detachably mounted to each other, characterized by means for pressing a developing roller constituting the developing unit onto a latent image carrier constituting the latent image carrier unit in a follow-up manner in association with at least one of the operation for mounting the latent image carrier unit to the developing unit and the operation for driving the image forming unit. In this structure, it is possible to constitute an image forming apparatus of a contact development system capable of assuredly pressing the latent image carrier onto the developing roller.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
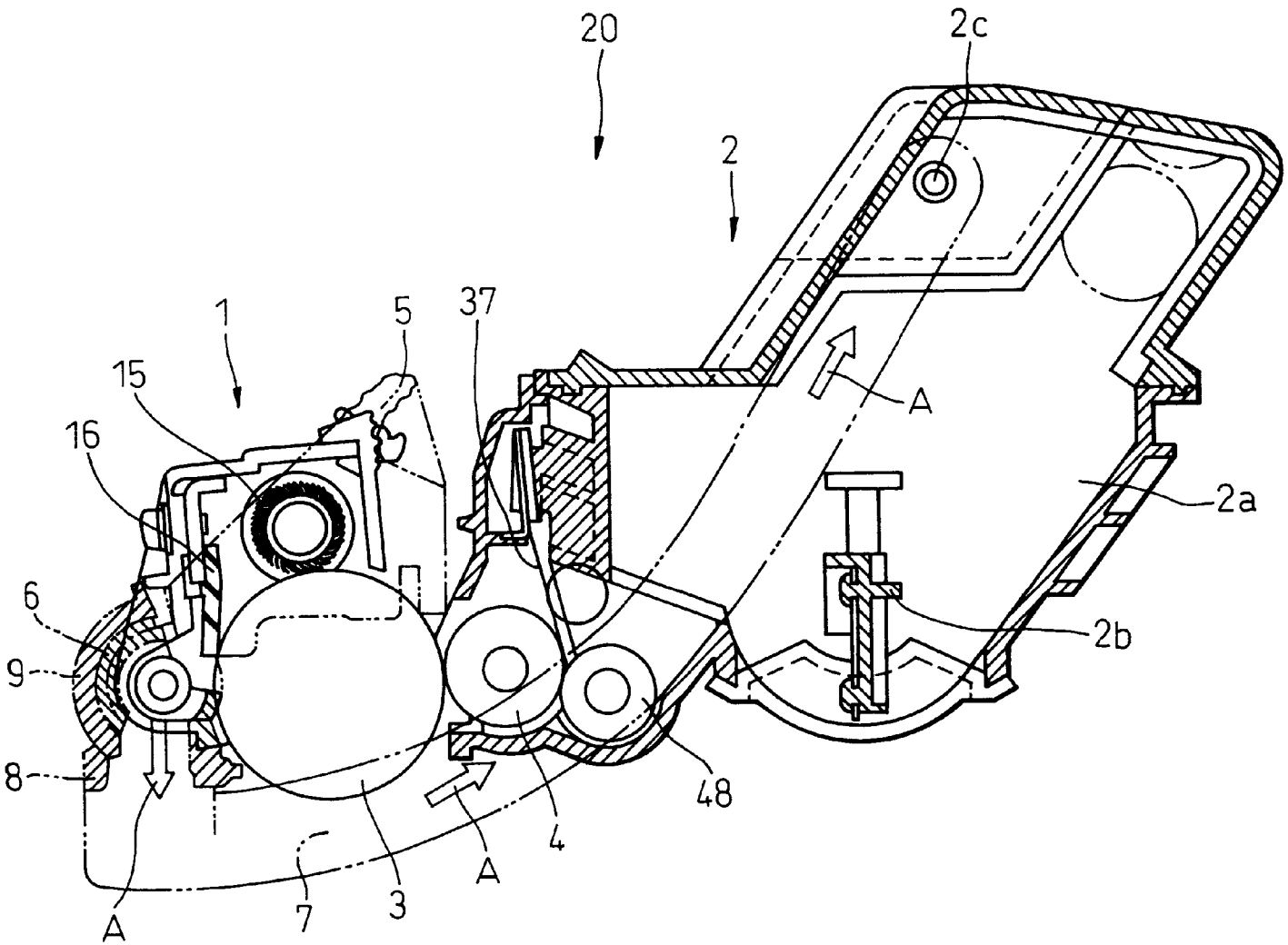
FIG. 1 is a partial sectional side view of an image forming unit according to the first embodiment of the present invention.

FIG. 1 is a partially sectional side view of an image forming unit including a photosensitive drum unit and a developing unit according to the first embodiment of the present invention. The image forming unit 20 includes the photosensitive drum unit (latent image carrier unit) 1 and the developing unit 2. The photosensitive drum unit 1 is detachably assembled to the developing unit 2. The photosensitive drum unit 1 has a photosensitive drum (latent image carrier) 3, a charging brush 15, a cleaning blade 16 and a waste toner receptacle 6, while the developing unit 2 has a toner chamber 2*a,* a developing roller 4 disposed at an exit of the toner chamber 2*a* and a toner returning mechanism 7.

According to the present invention, the waste toner receptacle 6 and the toner returning mechanism 7 are engageable with each other, when the photosensitive drum unit 1 is mounted to the developing unit 2, and are releasable from each other when the photosensitive drum unit 1 is detached from the developing unit 2. That is, the image forming unit 20 has a joint structure 8 for detachably attaching the waste toner receptacle 6 to the toner returning mechanism 7, and a lever opening/closing mechanism 5 for permitting the toner to enter the toner returning mechanism 7 from the bottom of the waste toner receptacle 6.

In such a manner, it is possible to detach and attach the photosensitive drum unit 1 from and to the developing unit 2 without splashing the toner, by providing the engagement structure and the lever opening and closing mechanism 5. It is possible for the user to replace the photosensitive drum unit 1 and the developing unit 2 independently of each other. Accordingly, it is possible to effectively use one of the photosensitive drum unit 1 and the developing unit 2 after the duration of life of the other has lapsed.

Figure 2A:
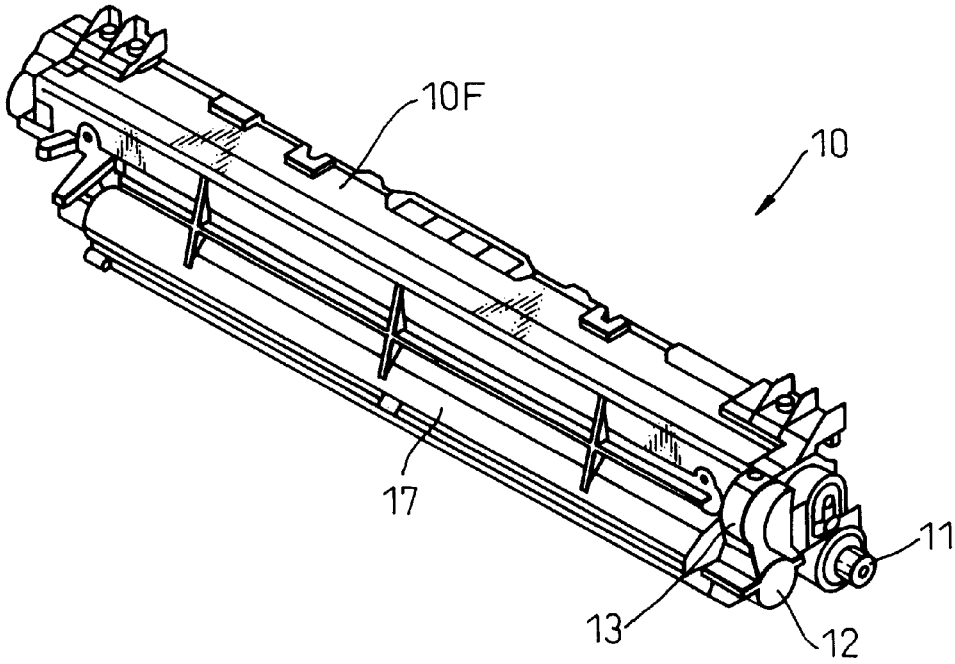
FIG. 2A is a perspective view of a photosensitive drum unit of an image forming unit according to the second embodiment of the present invention.
Figure 2B:
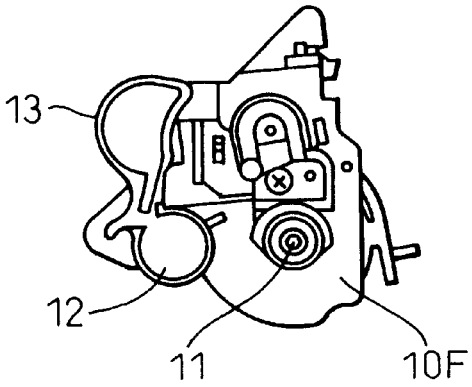
FIG. 2B is a left side view of the photosensitive drum unit shown in FIG. 2A.
Figure 2C:
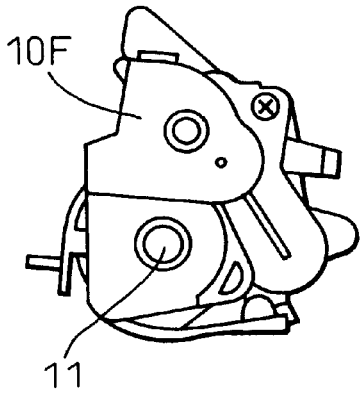
FIG. 2C is a right side view of the photosensitive drum unit shown in FIG. 2A.

FIG. 2A is a perspective view showing a photosensitive drum unit of an image forming unit according to the second embodiment of the present invention. FIG. 2B is a left side view of the photosensitive drum unit of FIG. 2A, and FIG. 2C is a right side view of the photosensitive drum unit of FIG. 2A. The photosensitive drum unit 10 can be marketed as an independent unit.

Figure 7:
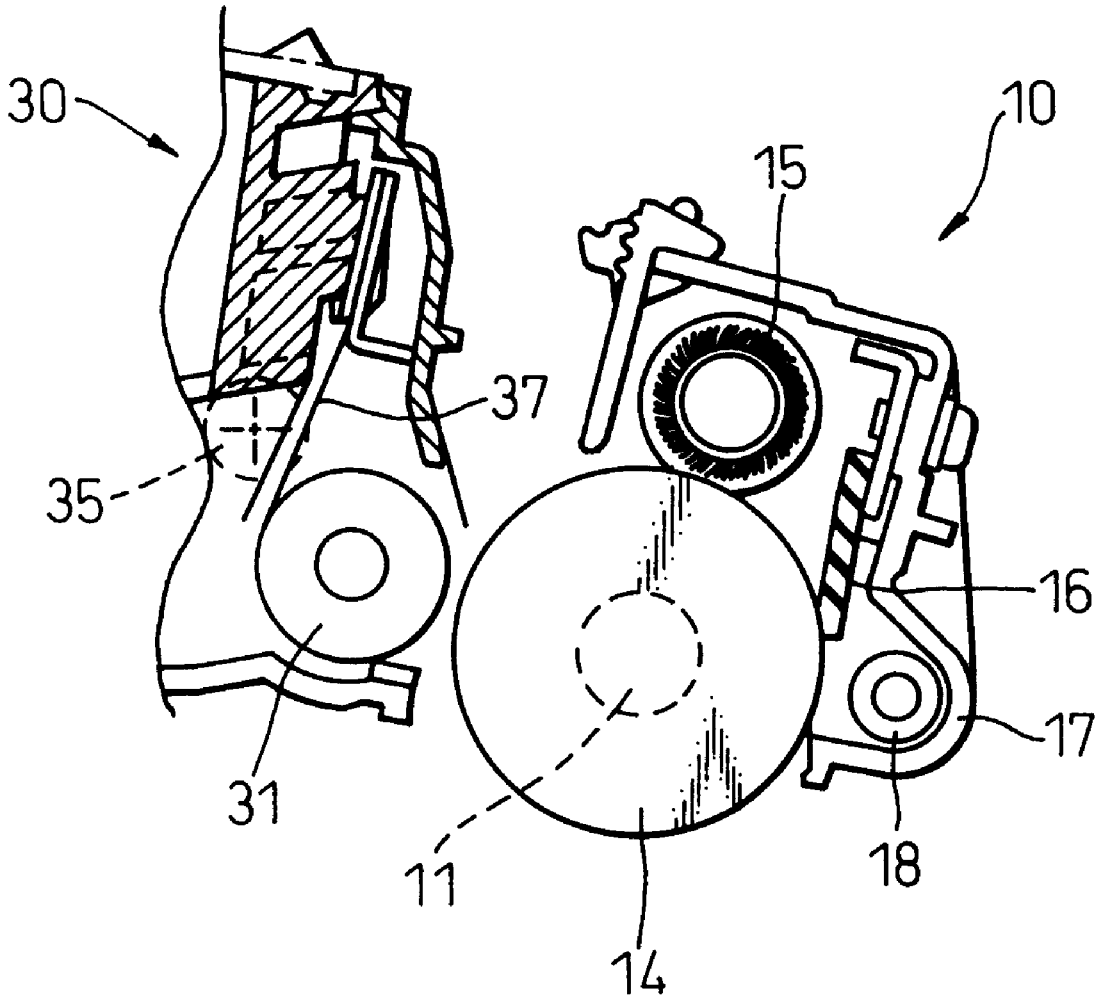
FIG. 7 is a sectional view showing part of the photosensitive drum unit and the developing unit, in the state immediately before the photosensitive drum unit abuts to the developing unit.

The photosensitive drum unit 10 has a unit frame 10F. As shown in FIG. 7, the photosensitive drum unit 10 includes a photosensitive drum (latent image carrier) 14, a charging brush 15 and a cleaning blade 16, all of which are arranged in the unit frame 10F of the photosensitive drum unit 10. Further, a waste toner tank (waste toner receptacle) 17 is disposed beneath the cleaning blade 16 and has a conveyor screw 18 therein.

Figure 2D:
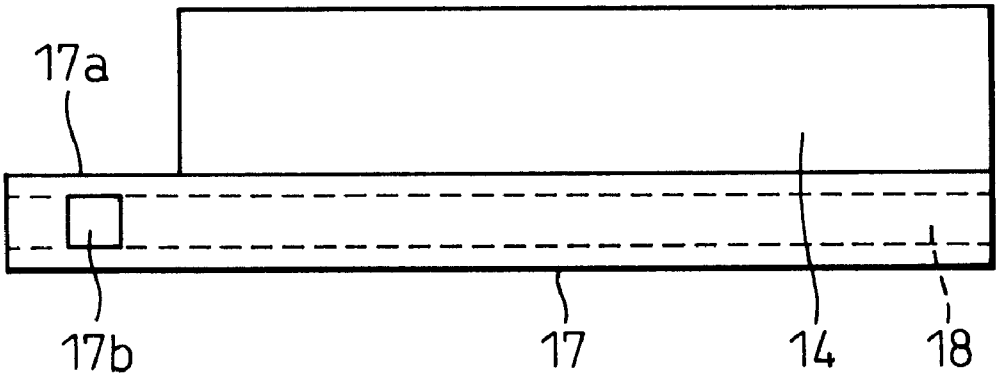
FIG. 2D is a simplified bottom view illustrating the photosensitive drum and the waste toner tank.

FIG. 2D is a bottom view simply showing part of the drum unit 10 of FIG. 2A, wherein the waste toner tank 17 extends along the photosensitive drum 14 and has a cylindrical portion 17*a* at one end thereof. The cylindrical portion 17*a* has an opening 17*b* directed downward. The conveyor screw 18 is disposed substantially along the entire length of the waste toner tank 17 and the cylindrical portion 17*a* to transport the waste toner scraped off from the photosensitive drum 14 by the cleaning blade 16 along the waste toner tank 17 toward the cylindrical portion 17*a*. The waste toner falls into a toner returning pipe (toner returning mechanism) 39 through the opening 17*b* of the cylindrical portion 17*a*.

Figure 2E:
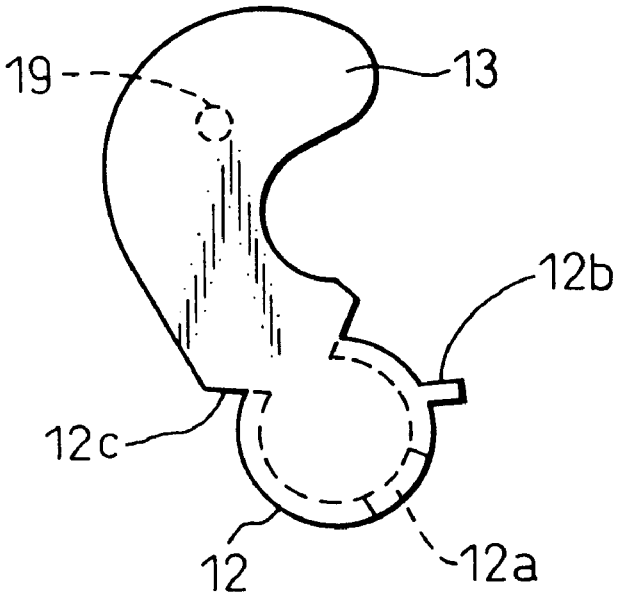
FIG. 2E is a simplified side view illustrating the engagement lever of the photosensitive drum unit.

As shown in FIGS. 2A to 2C, the photosensitive drum unit 10 has drum shafts 11 extending outward from the opposite side walls of the unit frame 10F, a toner returning cylinder 12 disposed on an extension of the waste toner tank 17, and an engagement lever 13. As shown in FIG. 2E, the toner returning cylinder 12 and the engagement lever 13 are formed as a one-piece structure. The toner returning cylinder 12 is rotatably fitted on the cylindrical portion 17*a* of the waste toner tank 17. When the engagement lever 13 is operated, the toner returning cylinder 12 turns about the cylindrical portion 17*a*. The toner returning cylinder 12 has an opening 12*a* which is movable between a position to be aligned with the opening 17*b* of the cylindrical portion 17*a* and another position not to be aligned with the opening 17*b* of the cylindrical portion 17*a*. Further, the toner returning cylinder 12 has two engagement projections 12*b* and 12*c*.

Figure 3A:
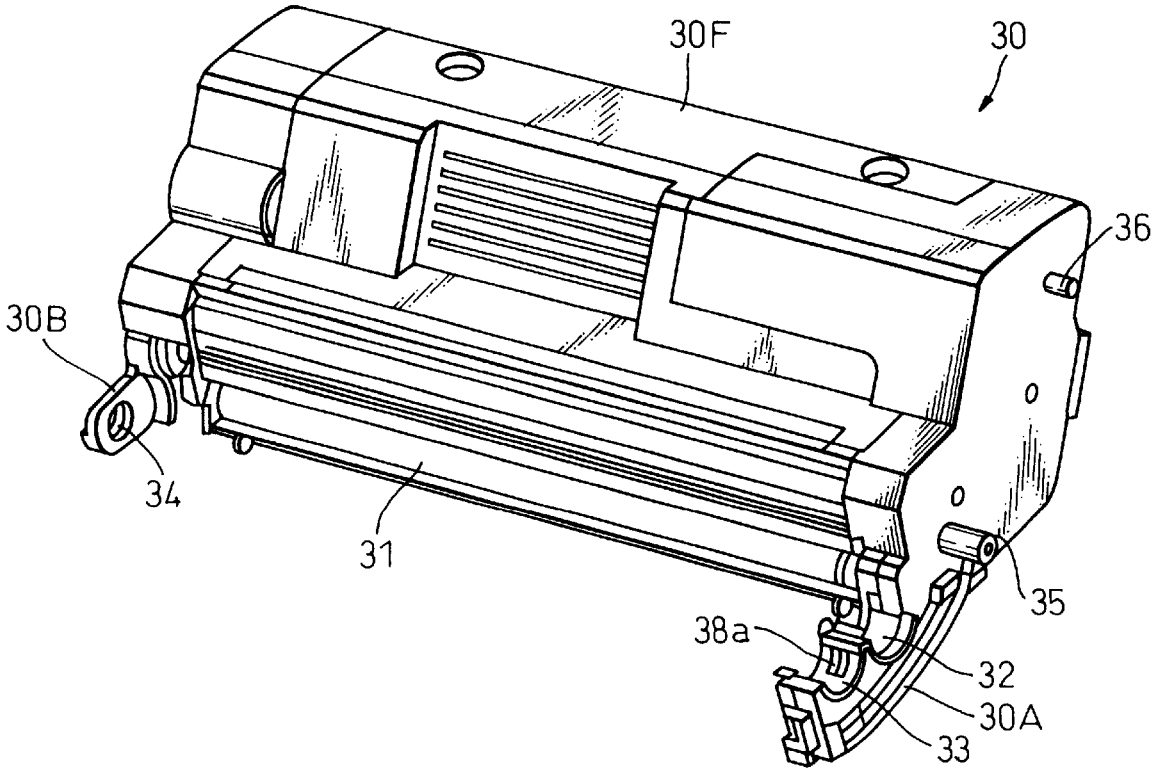
FIG. 3A is a perspective view illustrating a developing unit of the image forming unit according to the second embodiment of the present invention.
Figure 3B:
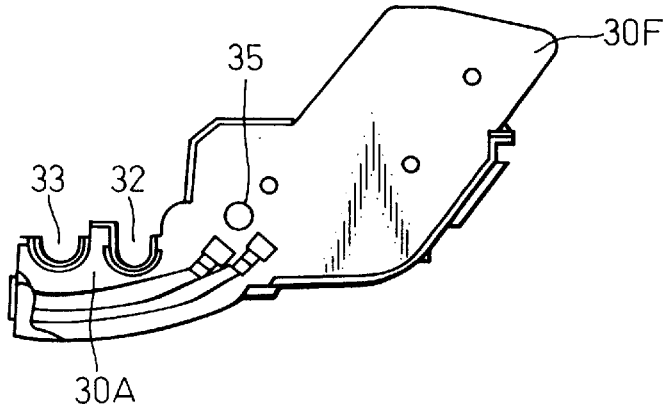
FIG. 3B is a right side view of the developing unit shown in FIG. 3A.
Figure 3C:
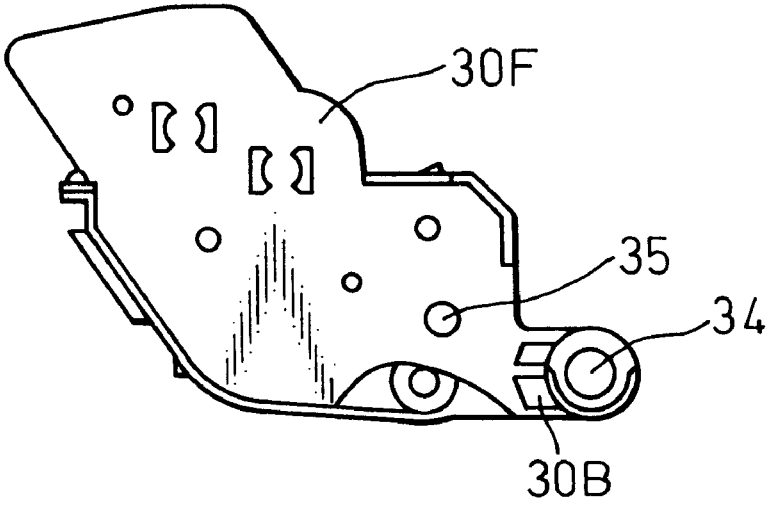
FIG. 3C is a left side view of the developing unit shown in FIG. 3A.

FIG. 3A is a perspective view showing a developing unit 30 of the image forming unit according to the second embodiment of the present invention; FIG. 3B is a right side view of the developing unit 30; and FIG. 3C is a left side view of the developing unit 30. The developing unit 30 could be marketed as an independent unit.

The developing unit has a unit frame 30F. Some of the components included in the developing unit 30 are shown in FIG. 7. An overall structure of the developing unit 30 is the same as that shown in FIG. 1. In FIGS. 1 and 7, the developing unit 30 includes a toner chamber 2*a,* a developing roller 31, a doctor blade 37, a reset roller 48 and a toner returning pipe 39, all of which are arranged in the unit frame 30F. An agitator 2*b* is disposed in the toner chamber 2*a,* and a toner returning port 2*c* communicating with the toner returning pipe 39 opens at a position above the toner chamber 2*a*. Note that development is carried out in this developing unit 30 by using a non-magnetic single component toner.

As shown in FIGS. 3A to 3C, rotary shafts 35 of the developing unit extend outward from the opposite side walls of the unit frame 30F. As shown in FIG. 7, the rotary shafts 35 of the developing unit deviate from the axis of the developing roller 31, while the drum shafts 11 are coaxially aligned with the photosensitive drum 14. Accordingly, when the developing unit 30 is made to rotate about the rotary shafts 35, the developing roller 31 moves toward or away from the photosensitive drum 14. If the developing unit 30 is applied with a force so that the developing roller 31 approaches the photosensitive drum 14, it is possible to more assuredly bring the developing roller 31 into contact with the photosensitive drum 14.

Figure 3D:
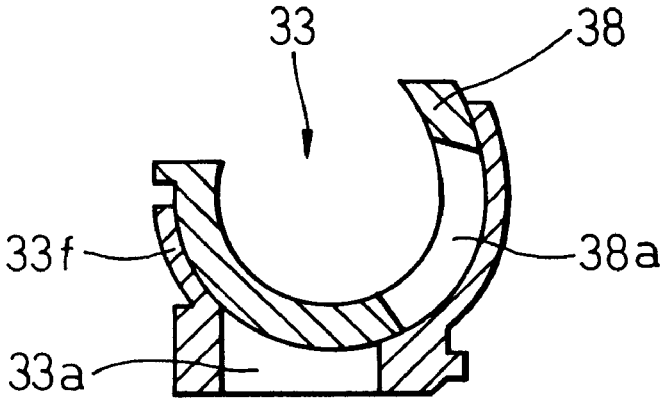
FIG. 3D is a side view of the shutter attached to a groove of the toner returning joint of the developing unit.

As shown in FIG. 3A, the unit frame 30F has arm portions 30A and 30B projecting rearward from the opposite side walls thereof. A drum shaft mounting groove 32 of a semicircular cross-sectional shape and a toner returning joint groove 33 of a semicircular cross-sectional shape are provided in the right arm portion 30A, while a drum shaft through hole 34 is provided in the left arm portion 30B. The toner returning pipe 39 is arranged in the right arm portion 30A and has an opening beneath the toner returning joint groove 33. As shown in FIG. 3D, the toner returning joint groove 33 comprises a support wall section (wall of the arm portion 30A) 33*f* of a semicircular cross-sectional shape and a shutter 38 of a semicircular cross-sectional shape rotatably coupled in the support wall section 33*f*. The shutter 38 has an opening 38*a*, and the support wall section 33*f* has an opening 33*a*. In FIG. 3D, the opening 38*a* of the shutter 38 is not aligned with the opening 33*a* of the support wall section 33*f*.

Figure 4A:
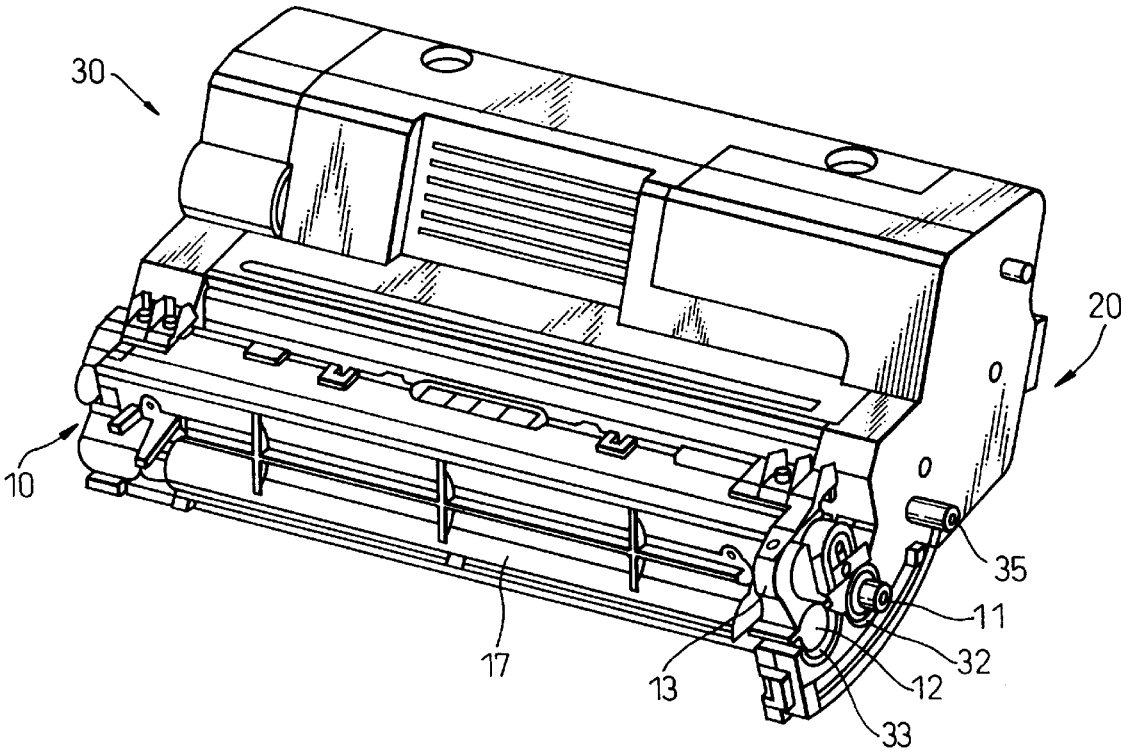
FIG. 4A is a perspective view illustrating the image forming unit comprising the photosensitive drum unit of FIGS. 2A to 2E and the developing unit of FIGS. 3A to 3D.
Figure 4B:
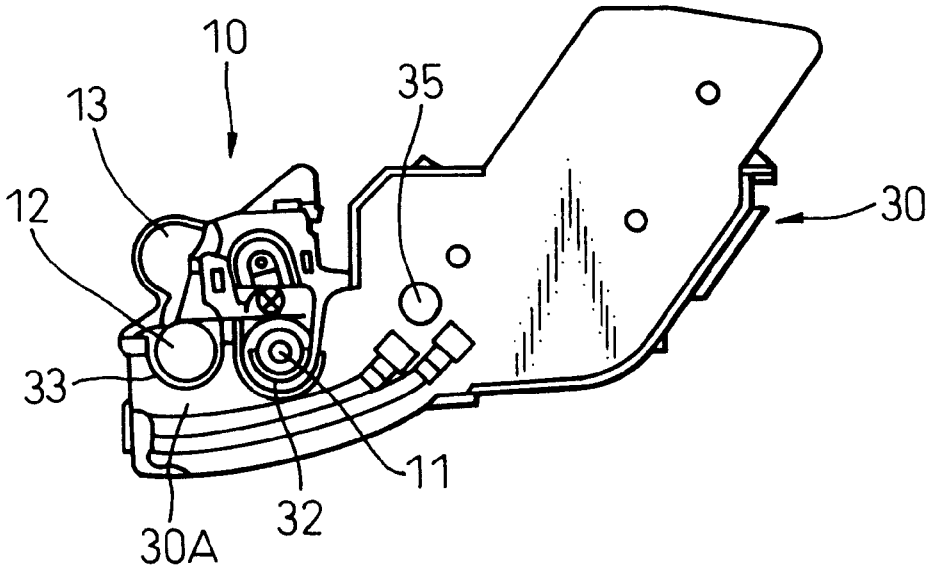
FIG. 4B is a right side view of the image forming unit shown in FIG. 4A.
Figure 4C:
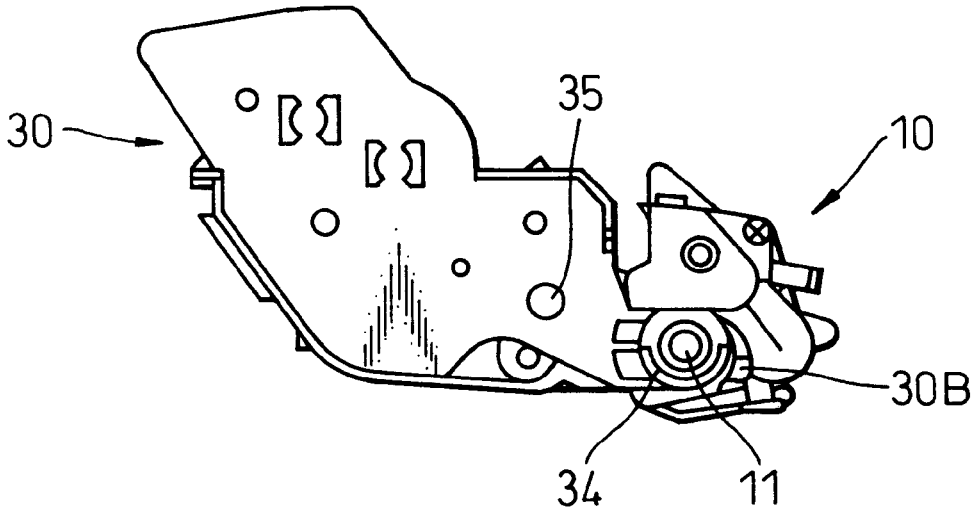
FIG. 4C is a left side view of the image forming unit shown in FIG. 4A.

FIG. 4A is a perspective view showing the image forming unit 20 wherein the photosensitive drum unit 10 is attached to the developing unit 30; FIG. 4B is a right side view of the image forming unit 20 and FIG. 4C is a left side view of the image forming unit 20. FIGS. 4A to 4C show a state in which the engagement lever 13 provided in the photosensitive drum unit 10 is not locked. One drum shaft 11 of the photosensitive drum unit 10 is inserted into the drum shaft through-hole 34 of the arm portion 30B of the developing unit 30, while the other drum shaft 11 is seated in the drum shaft mounting groove 32 from above, thus completing the engagement. The toner returning cylinder 12 of the photosensitive drum unit 10 is seated in the toner returning joint groove 33 from above, thus completing the engagement. In such a manner, the waste toner tank 17 is simply and easily engageable or connectable with the toner returning pipe 39.

In this state, if the engagement lever 13 is tilted in the right direction in FIG. 4B, the photosensitive drum unit 10 is coupled to the developing unit 30, and the toner returning cylinder 12 and the toner returning pipe 39 are communicated with each other, which allows the waste toner to be delivered into the toner returning pipe 39. In this regard, the description will be made in more detail later with reference to FIGS. 8A and 8B.

Figure 5:
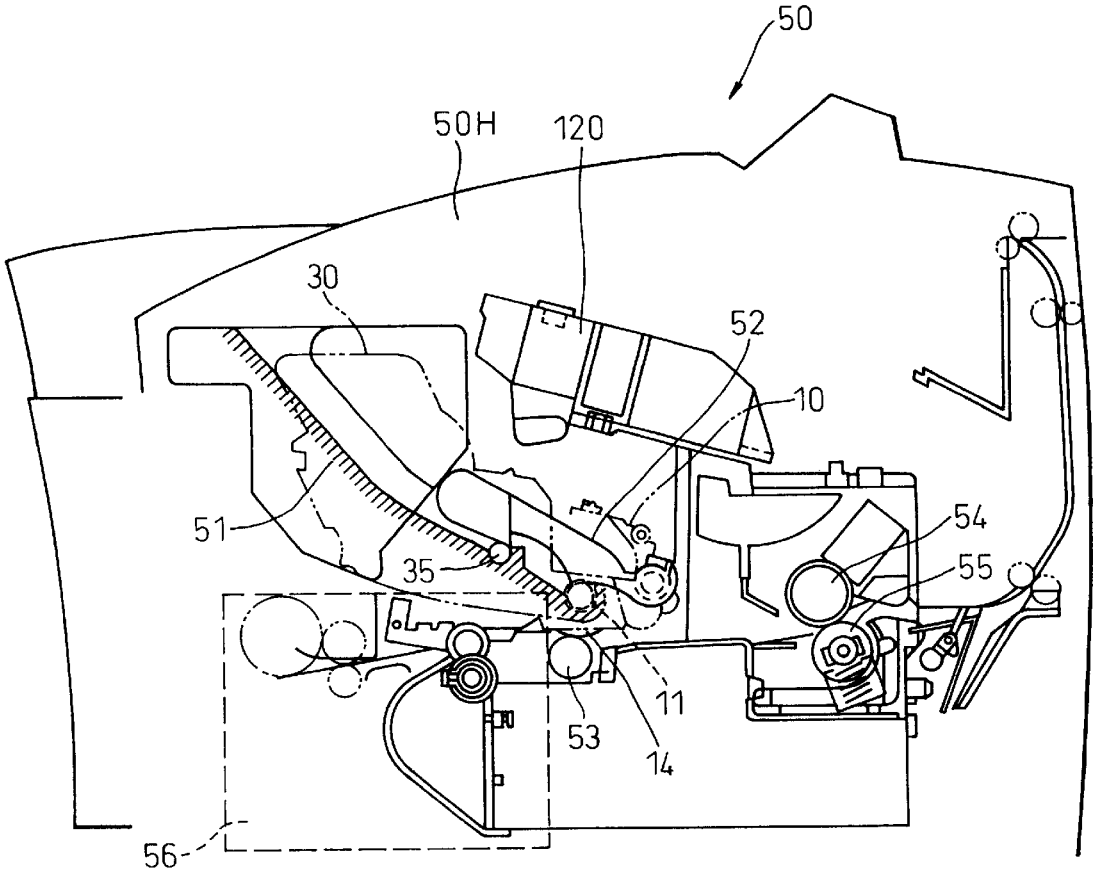
FIG. 5 is a partial sectional side view showing an image forming apparatus including the image forming unit of FIG. 4A.
Figure 6:
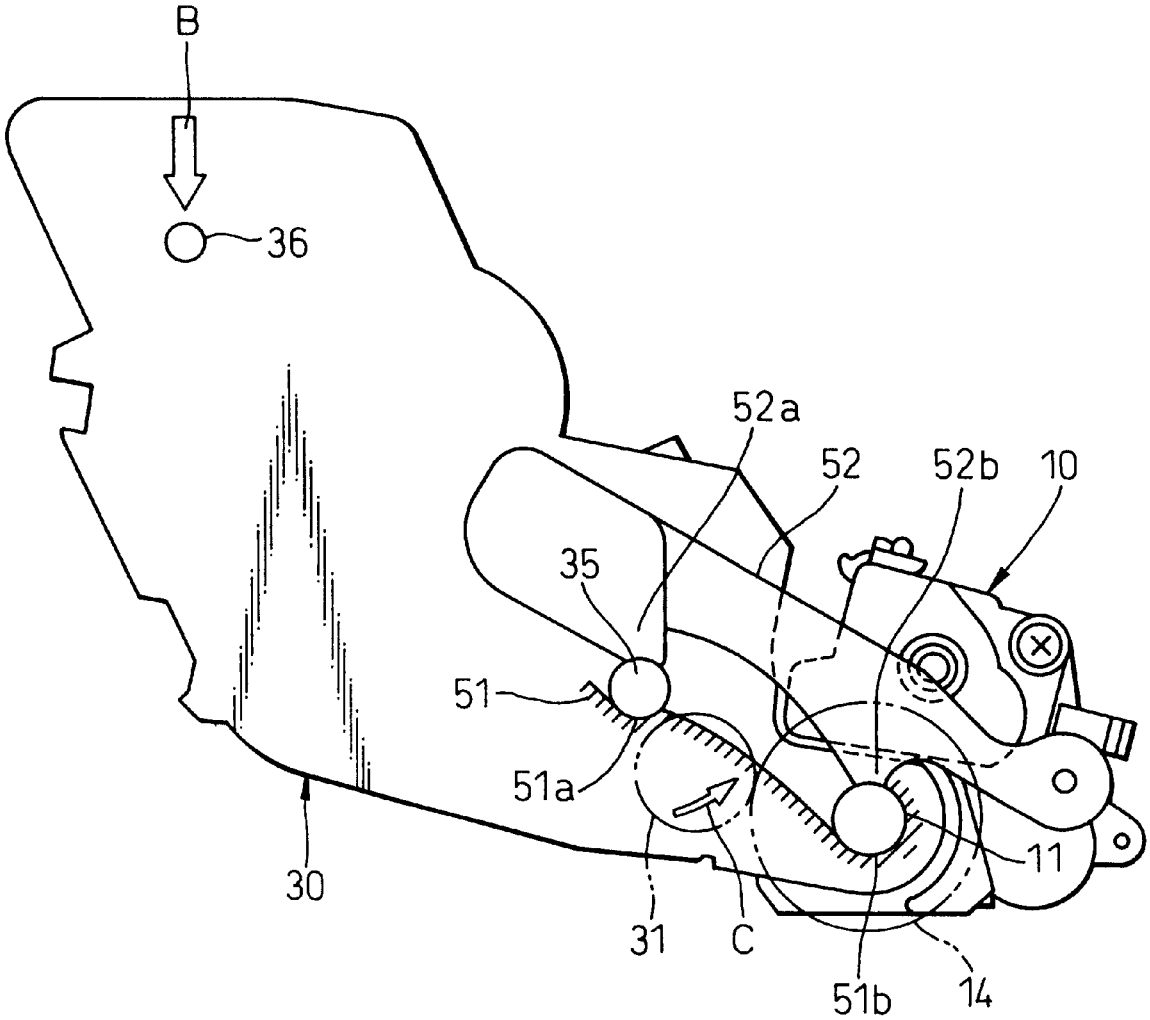
FIG. 6 is a partial enlarged view of the apparatus of FIG. 5 with the image forming unit attached to the body of the apparatus.

FIGS. 5 and 6 show an image forming apparatus 50 including the image forming unit 20 illustrated in FIGS. 2A to 4C. The image forming apparatus 50 includes, together with the above-mentioned components of the developing unit 30 and the photosensitive drum unit 10, an optical unit 120 such as a laser or LED, a transfer roller 53, a fixing device comprising a heating fixing roller 54 and a presser roller 55, and a sheet conveying device 56. Since the basic operation of the image forming apparatus 56 is well-known, only a brief description thereof will be made herein. The photosensitive drum 14 is uniformly charged by the charging brush 15, and a static latent image is formed on the surface of the photosensitive drum 14 by the optical unit 120. The static latent image is supplied with toner via the developing roller 31 to form a toner image. In the toner chamber 2*a*, the toner is charged by the friction thereof with the reset roller 48 and supplied to the developing roller 31. The toner thus supplied is restricted to have a predetermined thickness and additionally charged by the action of the doctor blade 37. The toner left on the surface of the developing roller 31 without being used for the development is scraped off therefrom by the reset roller 48. The toner image is transferred from the photosensitive drum 14 to a sheet conveyed by the sheet conveying mechanism 56 by the static attraction of the transferrer 53, and fixed on the sheet by the fixing device. The sheet carrying the image thus formed is discharged from the image forming apparatus 50. The toner left on the photosensitive drum 14 is scraped off therefrom as waste toner by the cleaning blade 16 and received by the waste toner tank 17. The waste toner recycles from the waste toner tank 17 to the toner chamber 2*a* of the developing unit 30 through the toner returning pipe 39.

The image forming apparatus 50 has a housing 50H, of which lateral side wall have guide rails 51, hatched in FIGS. 5 and 6, and a drum shaft pressing lever 52. The guide rail 51 has two recessed portions 51*a* and 51*b*, while the drum shaft pressing lever 52 has two pressers 52*a* and 52*b*. The developing unit rotary shaft 35 and the drum shafts 11 of the image forming unit 20 are mounted to the housing 50H of the image forming apparatus 50 in the recessed portions 51*a* and 51*b* of the guide rail 51, respectively, and held there by the pressers 52*a* and 52*b* of the drum shaft pressing lever 52. In such a manner, the image forming unit 20 can be simply and easily attached to the housing 50H of the image forming apparatus 50, or detached from the housing 50H of the image forming apparatus 50.

As shown in FIG. 6, after the image forming unit 20 is mounted to the image forming apparatus 50, a boss 36 provided in the developing unit 30 is pushed in the direction of arrow B, whereby the developing unit 30 is applied with a torque for rotating the same in the direction of arrow B about the developing unit rotary shaft 35. This causes the developing roller 31 to move in the direction of arrow C toward the photosensitive drum 14 so that the developing roller 31 abuts against the photosensitive drum 14 at a proper contact pressure. When the developing roller 31 abuts against the photosensitive drum 14 at a proper pressure, the developing roller 31 can supply a suitable amount of toner to the latent image on the photosensitive drum 14.

Figure 8A:
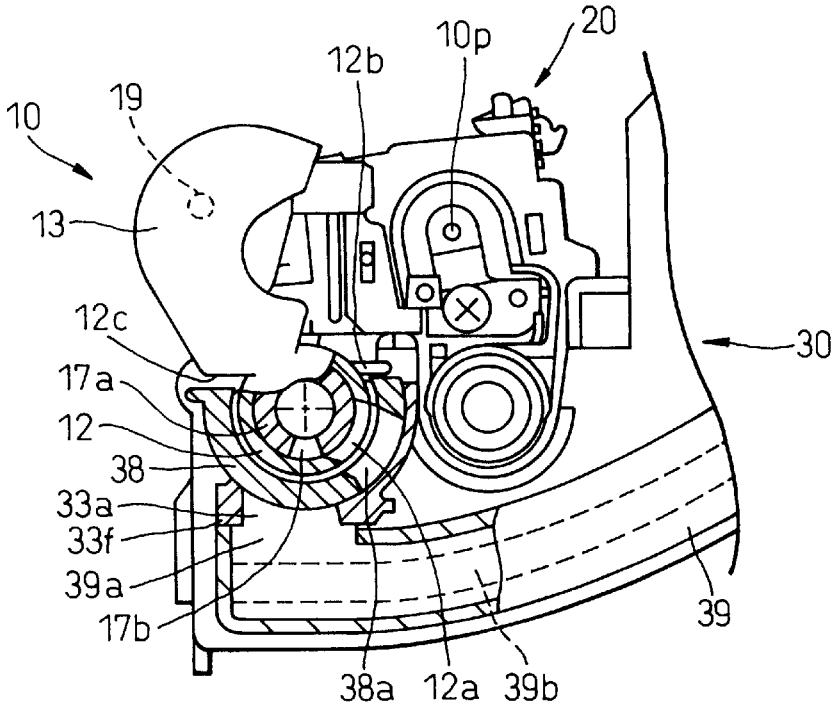
FIG. 8A is a sectional view of the joint portion between the waste toner tank and the toner returning pipe before the engagement lever is locked.

FIG. 8A shows the image forming unit 20 before the engagement lever 13 is locked. The engagement lever 13 is in a generally vertical position wherein the opening 12*a* of the toner returning cylinder 12, which is integral with the engagement lever 13, is not aligned with the opening 17*b* of the cylindrical portion 17*a* of the waste toner tank 17. That is, the toner returning cylinder 12 closes the opening 17*b* of the cylindrical portion 17*a* of the waste toner tank 17. Accordingly, in this state, the photosensitive drum unit 10 could be treated as a one-piece body. Note that the engagement lever 13 and the toner returning cylinder 12 are adapted to be rotatable relative to the photosensitive drum unit 10 but are not easily be removable therefrom.

The shutter 38 is adapted to be rotatable relative to the support wall 33*f* of the frame 30*f* of the developing unit 30 but is not easily removed therefrom. In the state wherein the photosensitive drum unit 10 is mounted to the developing unit 30, the cylindrical portion 17*a* of the waste toner tank 17, the toner returning cylinder 12 and the shutter 38 are coaxially arranged. When the engagement lever 13 is located at a position shown in FIG. 8A, the opening 38*a* of the shutter 38 is not aligned with the opening 33*a* of the support wall 33*f* of the developing unit 30 and the opening 39*a* of the toner returning pipe 39, whereby the shutter 38 closes the opening 39*a* of the toner returning pipe 39. In other words, the waste toner tank 17 and the toner returning pipe 39 are separated from each other Therefore, the developing unit 30 could be treated as a one-piece body in this state.

Figure 8B:
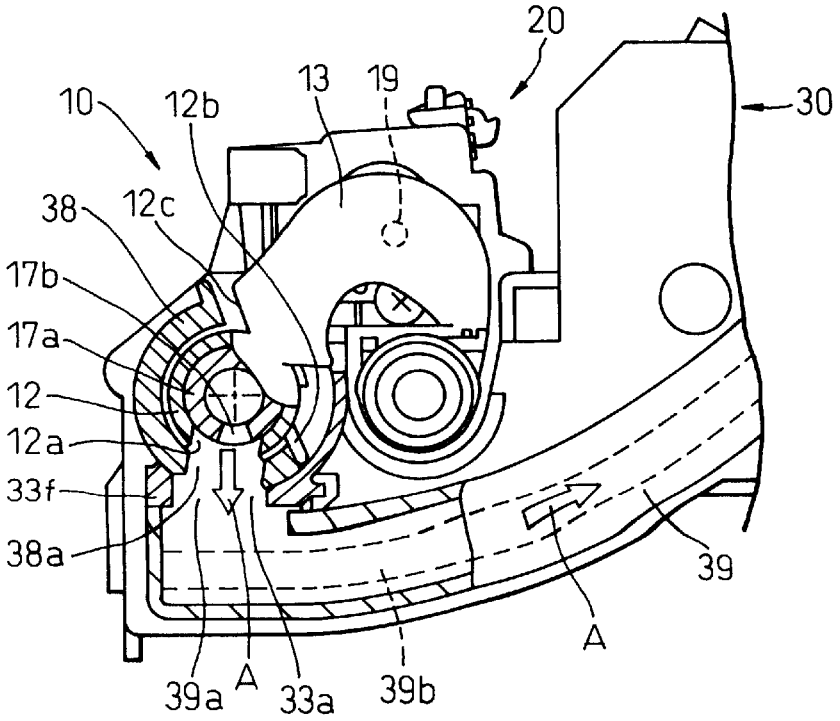
FIG. 8B is a sectional view similar to FIG. 8A, after the engagement lever is locked.

As shown in FIG. 8B, the engagement lever 13 is made to rotate in the clockwise direction and an engagement hole 19 provided in the inside of the engagement lever 13 is engaged with a projection (not shown) on the side surface of the developing unit 30, whereby the engagement lever 13 is locked. One 12*b* of the two engagement projections of the toner returning cylinder 12 is engageable with one end of the shutter 38, while the other 12*c* is engageable with the other end of the shutter 38. Accordingly, if the engagement lever 13 is made to rotate, the toner returning cylinder 12 and the shutter 38 also rotate.

When the engagement lever 13 is made to rotate in the clockwise direction, the opening 12*a* of the toner returning cylinder 12 is aligned with the opening 17*b* of the cylindrical portion 17*a* of the waste toner tank 17 to open the opening 17*b* and the opening 38*a* of the shutter 38 is aligned with the opening 33*a* of the support wall 33*f* and the opening 39*a* of the toner returning pipe 39 to open the opening 39*a* of the toner returning pipe 39. That is, the waste toner tank 17 and the toner returning pipe 39 are communicated with each other to allow the waste toner within the waste toner tank 17 to flow into the toner returning pipe 39 as shown by arrow A and return to the toner chamber 2*a* by a conveyor screw 39*b* provided in the toner returning pipe 39.

According to the second embodiment of the present invention, since the photosensitive drum unit 10 and the developing unit 30 are detachably mounted to each other by the engaging or coupling structure between the waste toner tank 17 and the toner returning pipe 39 and the lever opening/closing device, it is possible for the user to replace each of the photosensitive drum unit 10 and the developing unit 30 independently of the other in accordance with the respective duration of life thereof; i.e., to reduce waste in comparison with a case wherein the entirety of the image forming unit 20 is replaced with a new one.

In the image forming apparatus of the above-mentioned second embodiment, the axis of the image forming unit 20 i.e., a position of the drum shafts 11 and the developing unit rotating shaft 35 relies on the positional accuracy of the body of the apparatus. Therefore, if there is an occurrence in that the developing roller 31 abuts against the photosensitive drum 14 on the left part of the apparatus but is apart from the latter on the right part of the apparatus, the developing roller 31 does not uniformly abut against the photosensitive drum 14 even though the boss 36 in the developing unit 30 is pressed, resulting in printing defects such as blurring.

To eliminate instability of abutment between the photosensitive drum 14 and the developing roller 31, a reliable abutment mechanism may be provided in the main body of the apparatus. However, such a remodelling of the main body of the apparatus would necessarily be accompanied with a large change in design and in production line of the apparatus, and therefore it is difficult to do so in a case of a minor model change. To avoid such an inconvenience, a pressing mechanism is provided in the image forming unit 20 for assuredly abutting the photosensitive drum 14 against the developing roller 31, which necessitates no large remodelling of the main body of the apparatus.

The third embodiment of the present invention is provided with such a pressing mechanism, which will be described with reference to FIGS. 9A to 19. The third embodiment is an image forming apparatus of a contact development type using a non-magnetic single component toner.

Figure 9A:
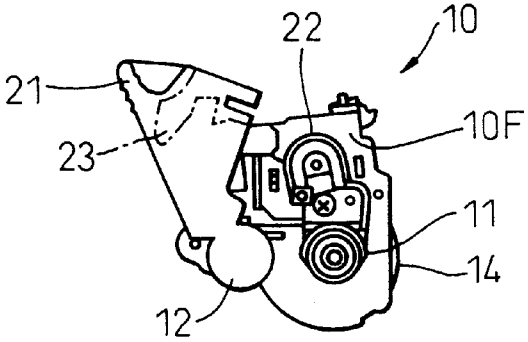
FIG. 9A is a left side view showing a photosensitive drum unit of an image forming unit according to the third embodiment of the present invention.
Figure 9B:
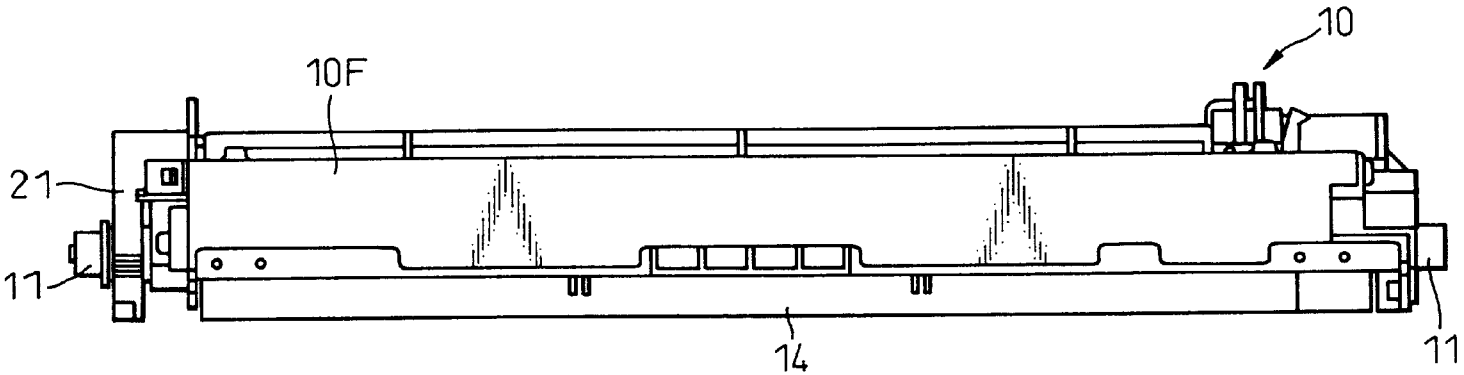
FIG. 9B is a top view of the photosensitive drum unit of FIG. 9A.
Figure 13:
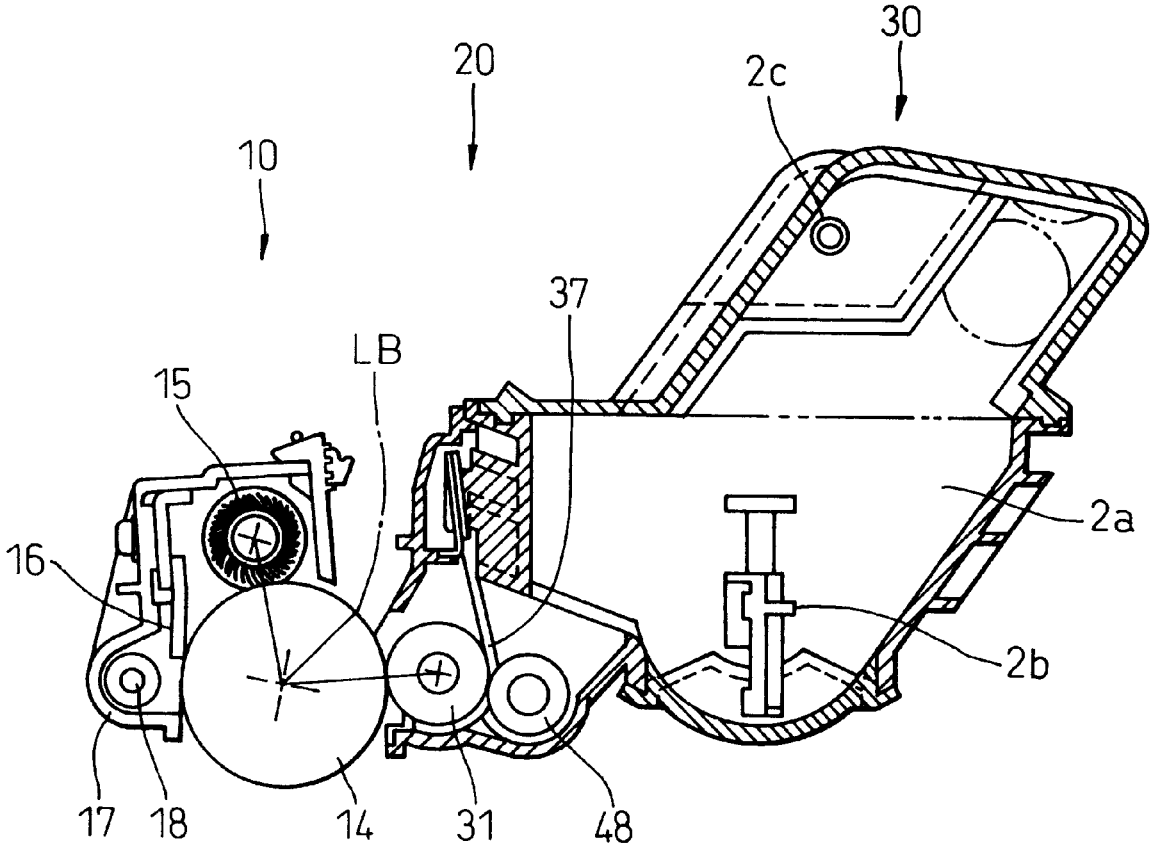
FIG. 13 is a sectional view of the assembled image forming unit.

FIG. 9A is a left side view of a photosensitive drum unit 10 of an image forming unit 20 according to the third embodiment, and FIG. 9B is a top view of the photosensitive drum unit 10. A basic structure of the photosensitive drum unit 10 of the third embodiment is the same as the photosensitive drum unit 10 of the second embodiment. That is, as shown in FIG. 13, the photosensitive drum unit 10 has a photosensitive drum 14, a charging brush 15, a cleaning blade 16, a waste toner tank 17 and a conveyor screw 18. Further, as shown in FIGS. 9A and 9B, the photosensitive drum unit 10 includes drum shafts 11, a toner returning cylinder 12 and an engagement lever 21. The engagement lever 21 is similar to that 13 of the preceding embodiment. The engagement lever 21 of this embodiment, however, has a guide groove 23 of a specific shape on the inside thereof.

Figure 10A:
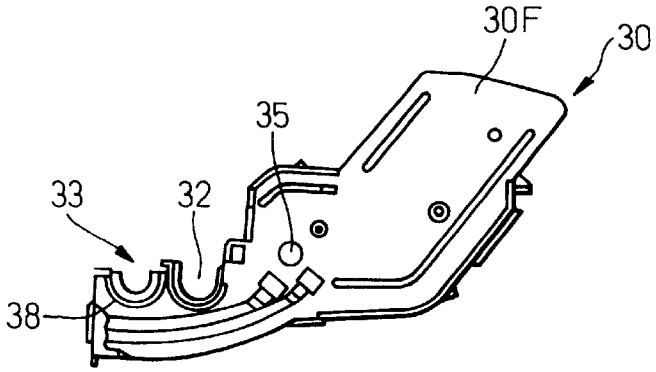
FIG. 10A is a left side view showing a developing unit of the image forming unit according to the third embodiment of the present invention.
Figure 10B:
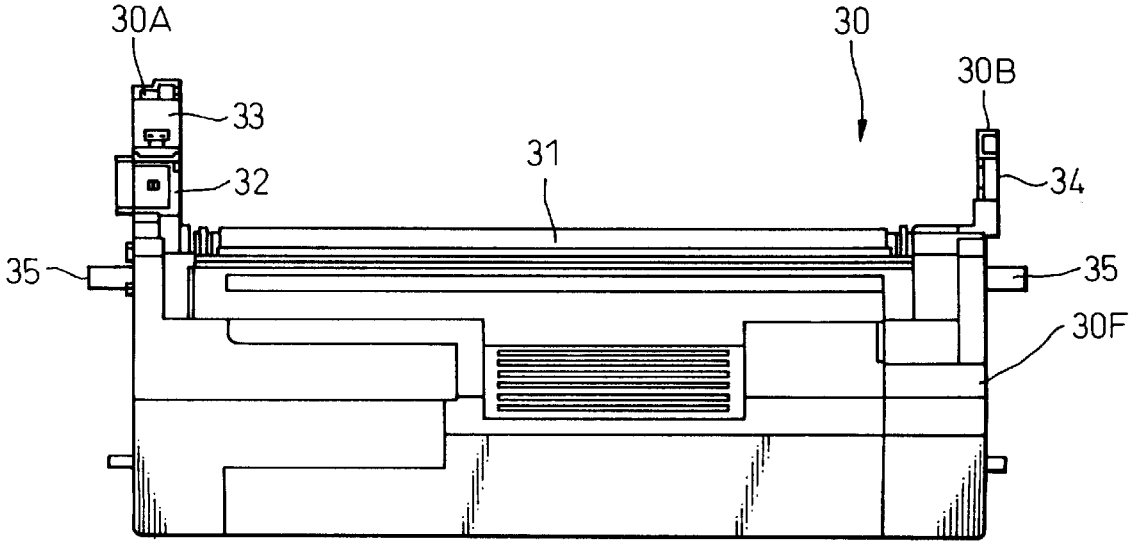
FIG. 10B is a top view of the developing unit of FIG. 10A.

FIG. 10A is a left side view of the developing unit 30 forming the image forming unit 20 according to the third embodiment of the present invention, and FIG. 10B is a top view thereof. A basic structure of the developing unit 30 is the same as that 30 of the second embodiment. That is, as shown in FIG. 13, the developing unit 30 has a toner chamber 2*a*, an agitator 2*b*, a developing roller 31, a doctor blade 37, a reset roller 48 and a toner returning pipe 39. Further, as shown in FIGS. 10A and 10B, the developing unit 30 includes developing unit rotary shafts 35, a drum shaft mounting groove 32, a toner returning joint groove 33 and a drum shaft through-hole 34. Further, the developing unit 30 has a slide lever 41 (FIGS. 11A and 11B).

Figure 11A:
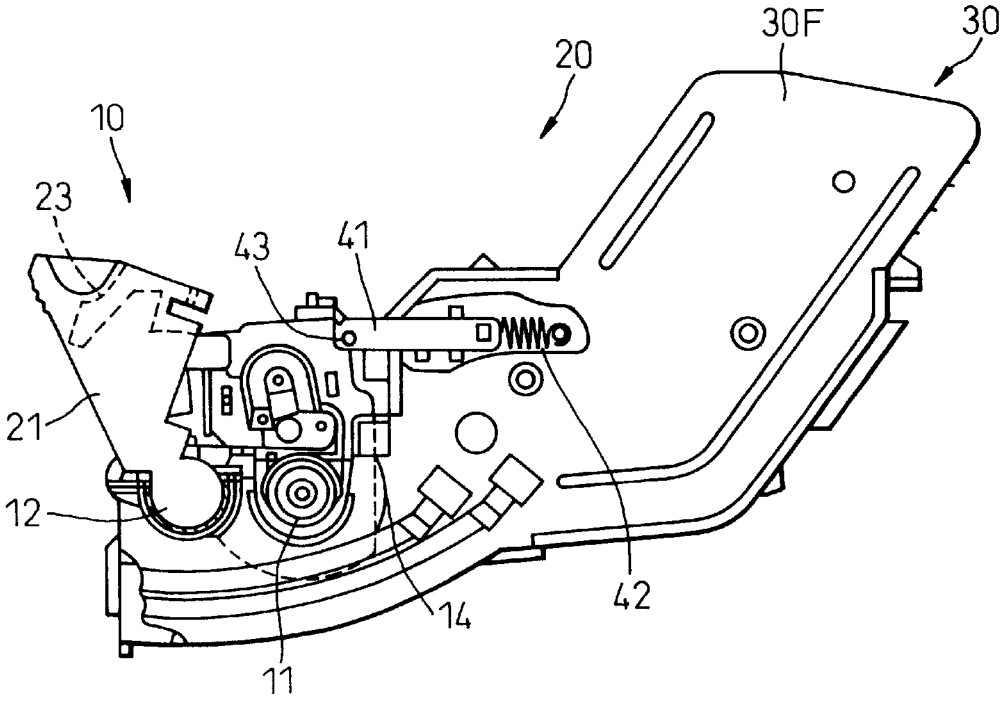
FIG. 11A is a left side view of the image forming unit including the photosensitive drum unit of FIGS. 9A and 9B and the developing unit of FIGS. 10A and 10B before the engagement lever is locked.

FIG. 11A is a left side view of the image forming unit 20 of the third embodiment of the present invention before the engagement lever 21 is locked. FIG. 11B shows a state wherein the engagement lever 21 is locked. The developing unit 30 has the slide lever 41 slidable in the horizontal direction, a right end of which is connected to the unit frame 30F by a tensile spring 42 and a left end thereof has a boss 43. The boss 43 is engageable with the guide groove 23 of the engagement lever 21 of the photosensitive drum unit 10.

Figure 11B:
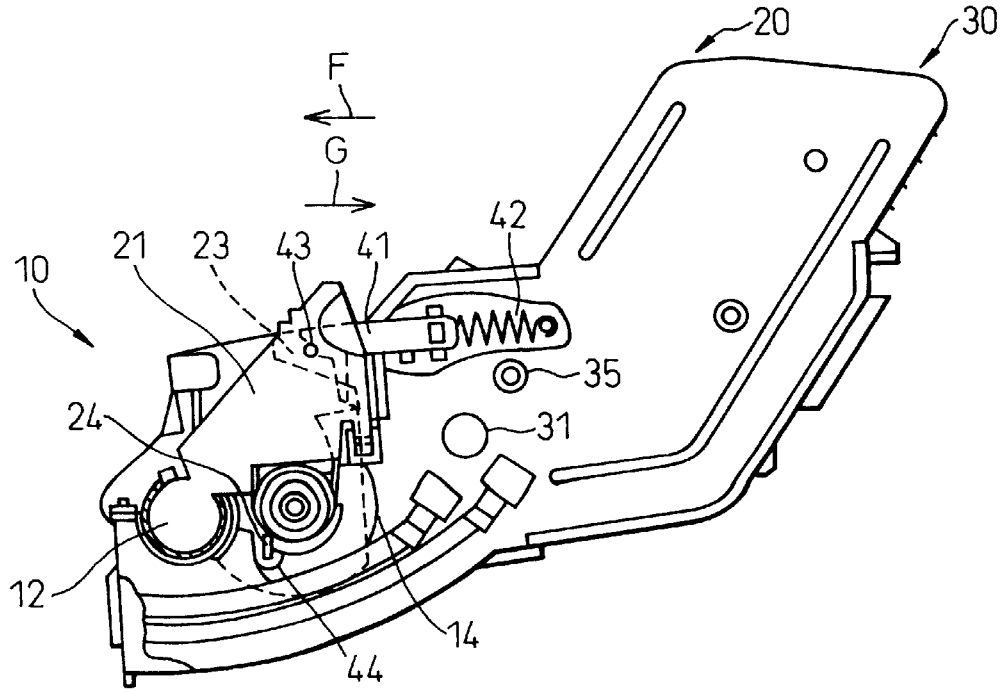
FIG. 11B is a left side view of the image forming unit of FIG. 11A, after the engagement lever is locked.

As shown in FIG. 11B, a boss 24 is provided in the side plate of the unit frame 10F of photosensitive drum unit 10, and an asymmetric U-shaped engagement groove 44 is provided on the inner surface of the side plate of the unit frame 30F of the developing unit 30. The boss 24 is engaged with the U-shaped engagement groove 44 and constitutes a fulcrum allowing the photosensitive drum unit 10 to pivot on the developing unit 30. The photosensitive drum unit 10 and the developing unit 30 are relatively movable in a limited range about the fulcrum. When the engagement lever 21 is made to rotate clockwise, the boss 43 engages with the guide groove 23 and moves along the surface of the guide groove 23, whereby the engagement lever 21 pulls the boss 43 of the developing unit 30. Due to the action of the tensile spring 42, the photosensitive drum unit 10 is pulled rightward as shown by arrow G, while the developing unit 30 is pulled leftward as shown by arrow F. Accordingly, the developing roller 31 is pressed onto the photosensitive drum 14, following the mounting movement of the photosensitive drum unit 10. In other words, this mechanism constitutes a pressing device operable following a mounting movement when the photosensitive drum unit 10 is mounted to the developing unit 30 for pressing the developing roller 31 onto the photosensitive drum l4.

Figure 12A:
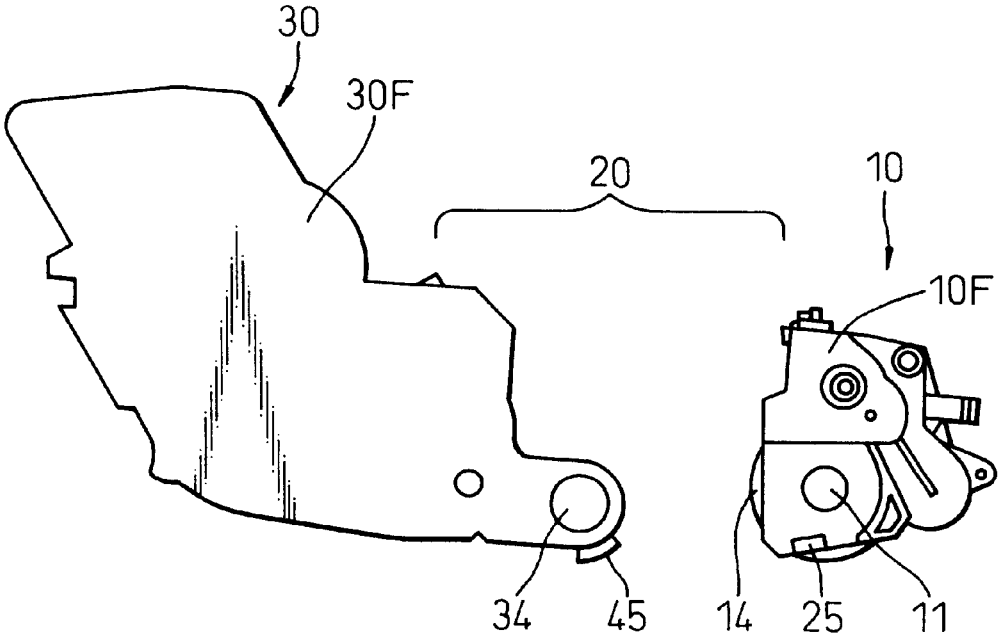
FIG. 12A is a right side view of the photosensitive drum unit and the developing unit separated from each other.
Figure 12B:
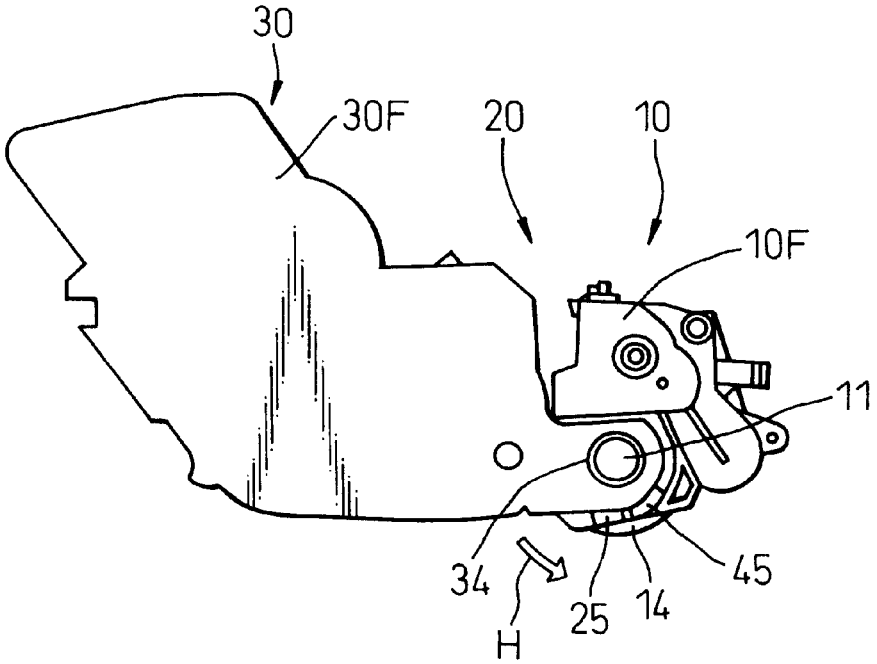
FIG. 12B is a right side view of the photosensitive drum unit and the developing unit assembled to each other.

FIG. 12A is a right side view of the image forming unit 20 of the third embodiment of the present invention prior to being assembled, while FIG. 12B is a right side view of the image forming unit 20 after being assembled. The photosensitive drum unit 10 has a projection 25 at the lower end of the right side wall of the unit frame 10F, and the developing unit 30 has a projection 45 at the lower end of the right side wall of the unit frame 30F. The projections 22 and 45 are provided at positions to be in contact with each other, and constitute a pressing device operable following a driving movement in the image forming unit 20 for pressing the developing roller 31 onto the photosensitive drum 14. As described later, the projection 25 is located on the left side of the projection 45 when the unit 10 is mounted to the unit 30, and the projection 25 moves to the right in FIG. 12B as the photosensitive drum 14 is driven to rotate, and abuts against the projection 45 to push the latter rightward, whereby the developing roller 31 is additionally pressed onto the photosensitive drum 14.

Figure 14:
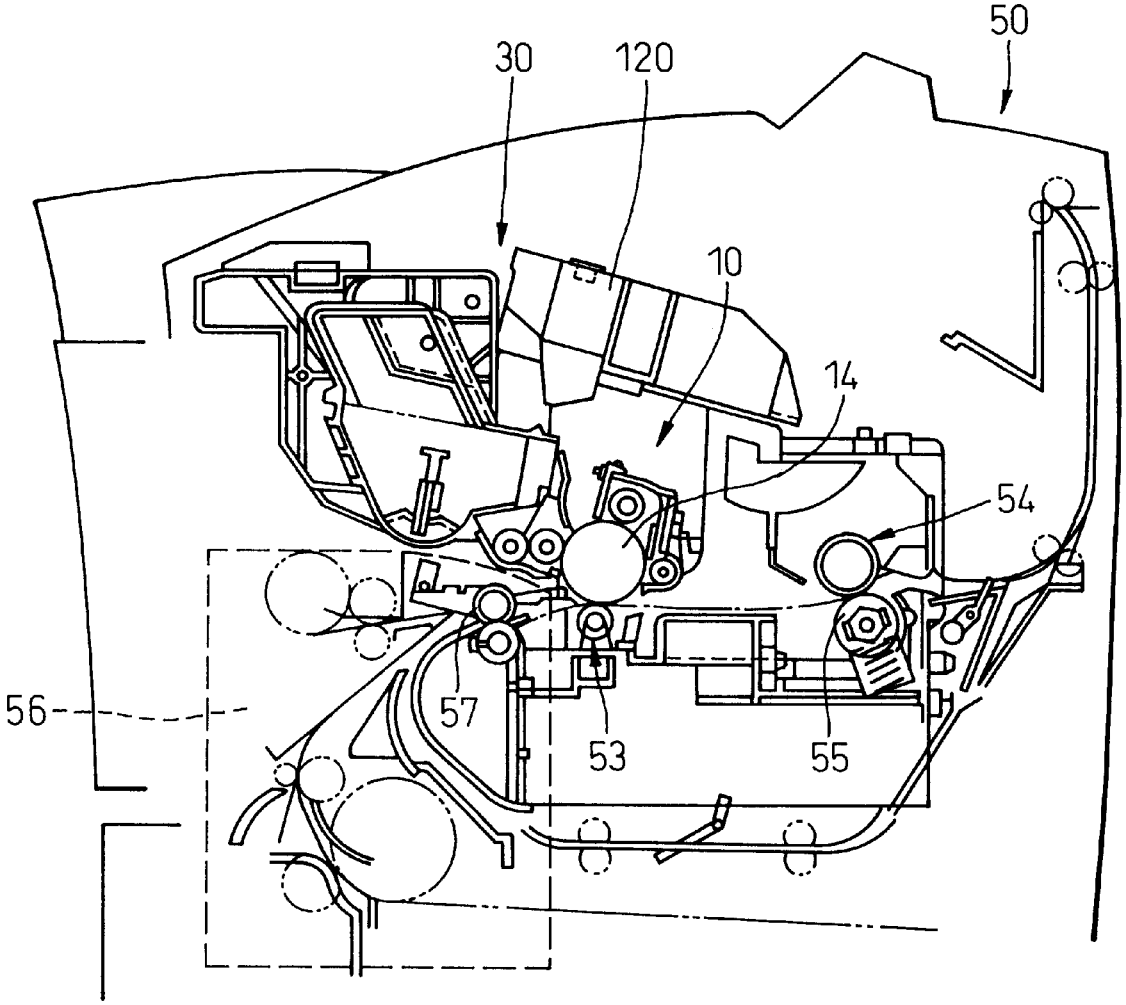
FIG. 14 is a sectional view of the image forming apparatus including the image forming unit shown in FIGS. 9A to 13.

FIG. 13 is a sectional view illustrating the image forming unit 20. FIG. 14 is a diagrammatic structural view of the image forming apparatus 50 including the image forming unit 20. In the image forming apparatus 50, a transfer roller 53 is disposed opposite to the photosensitive drum 14 at a position beneath the latter. Also, there are a fixing device consisting of a hot fixing roller 54 and a presser roller 55, and a sheet conveying mechanism 56 including a resist roller 57 and others.

By actuating the engagement lever 21 clockwise, the photosensitive drum unit 10 is mounted to the developing unit 30, whereby the photosensitive drum 14 abuts against the developing roller 31. During the operation of the image forming apparatus 50, the projection 25 abuts against the projection 45 as shown in FIGS. 12A and 12B to further press the photosensitive drum 14 onto the developing roller 31. In this state, a light beam is emitted from an optical unit 120 such as an LED array or a laser diode onto the surface of the photosensitive drum 14 through a gap between the developing unit 30 and the photosensitive drum unit 10 to form a static latent image thereon. The static latent image thus formed is developed by the toner supplied by the developing roller 31 which is in contact with the photosensitive drum 14.

Figure 15:
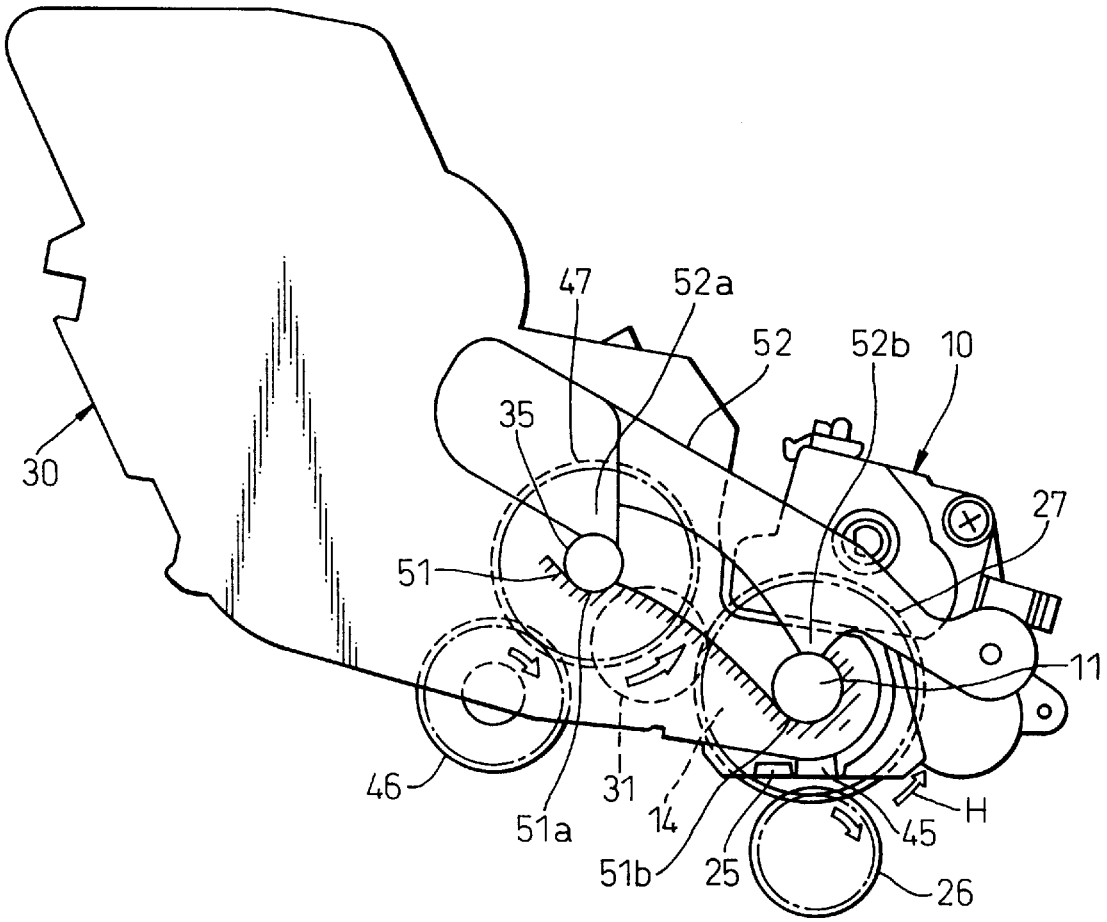
FIG. 15 is an enlarged view of the image forming apparatus with the image forming unit attached to a body of the former.

FIG. 15 is an enlarged view of the image forming unit 20 attached to the main body of the apparatus. The developing unit rotary shafts 35 and the drum shafts 11 of the image forming unit 20 are maintained in a locked state by actuating the engagement lever 21 rightward in the same manner as in the above-mentioned embodiment. The developing unit rotary shaft 35 and the drum shaft 11 are engaged with the recessed portions 51*a* and 51*b* of the guide rail 51 hatched in the drawing provided in the main body of the apparatus, and held therein by the pressers 52*a* and 52*b* of the drum shaft pressing lever 52 provided in the main body of the apparatus. In this regard, the drum shaft pressing lever 52 is connected to a spring for biasing the drum shaft pressing lever 52 toward the guide rail 51.

The image forming apparatus 50 has a drive motor (not shown), a drum drive gear 26 and a developing unit drive gear 46. The photosensitive drum unit 10 has a drum gear 27 to be meshed with the drum drive gear 26, and the developing unit 30 has a developing unit gear 47 to be meshed with the developing unit drive gear 46.

When the image forming apparatus is driven, a torque from the drive motor (not shown) is transmitted to the drum gear 27 via the drum drive gear 26 to rotate the photosensitive drum 14. The photosensitive drum 14 rotates anticlockwise as shown by an arrow H in FIG. 15. Accompanied therewith, the projection 25 provided on the side of the photosensitive drum unit 10 also rotates anticlockwise. That is, since the photosensitive drum 14 is strongly brought into contact with the cleaning blade 16 to generate a frictional force between the both, the photosensitive drum unit 10 is made to rotate as the photosensitive drum 14 rotates.

Accompanied therewith, the projection 25 of the photosensitive drum unit 10 is in contact with the projection 45 provided on the side of the developing unit 30 and presses the same, whereby the developing roller 31 is brought closer to the photosensitive drum 14. Accordingly, the developing roller 31 is pressed onto the photosensitive drum 14, following the driving movement when the image forming apparatus 50 is driven. While the image forming apparatus 50 is driven, the projection 25 is always urged by the driving force.

On the other hand, a torque from the drive motor (not shown) is transmitted to the developing unit gear 47 via the drive gear 46 to rotate the developing roller 31. The rotation of the developing unit gear 47 generates a force directed to the photosensitive drum 14 about the developing unit rotating shafts 35, whereby the developing roller 31 is pressed onto the photosensitive drum 14, following the driving movement.

Figure 16:
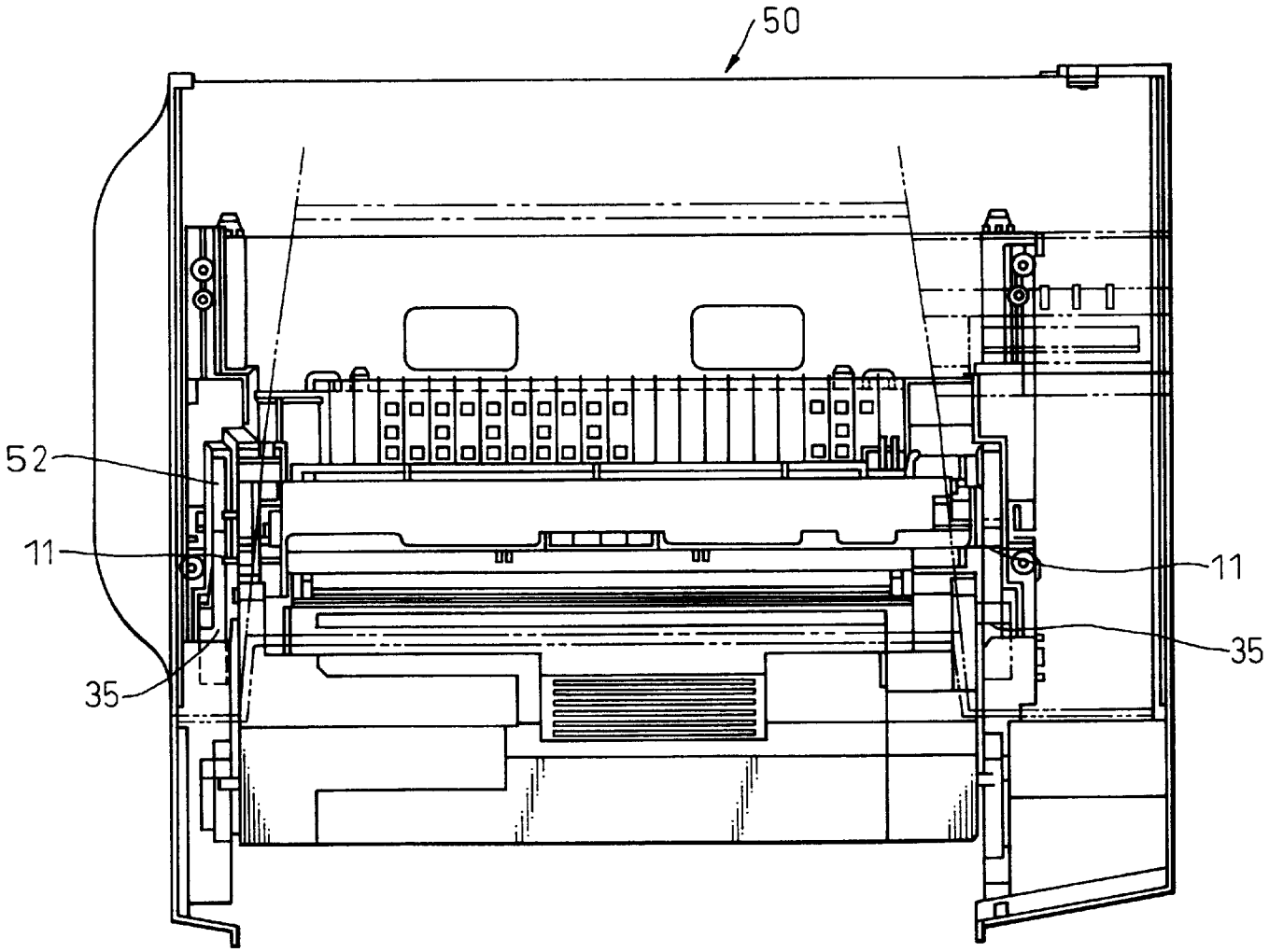
FIG. 16 is a top view of the image forming apparatus shown in FIG. 14.

FIG. 16 is a plan view of the image forming apparatus 50. The developing roller rotary shafts 35 and the drum shafts 11 are held by the drum shaft pressing levers 52 in the opposite side walls of the housing of the image forming apparatus 50.

Figure 17A:
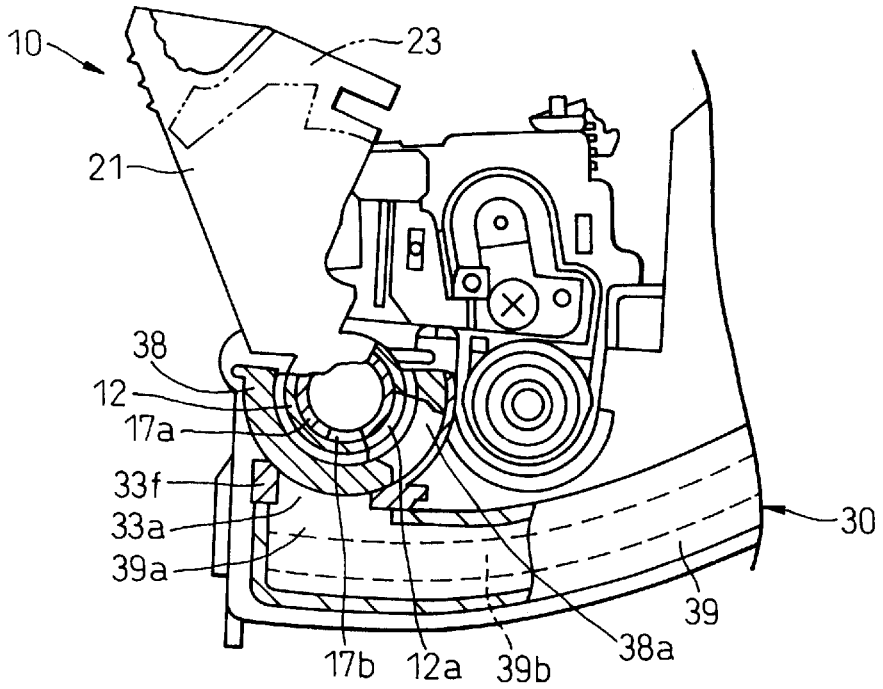
FIG. 17A. is a sectional view of a joint portion between the waste toner tank and the toner returning pipe while the engagement lever is not locked.
Figure 17B:
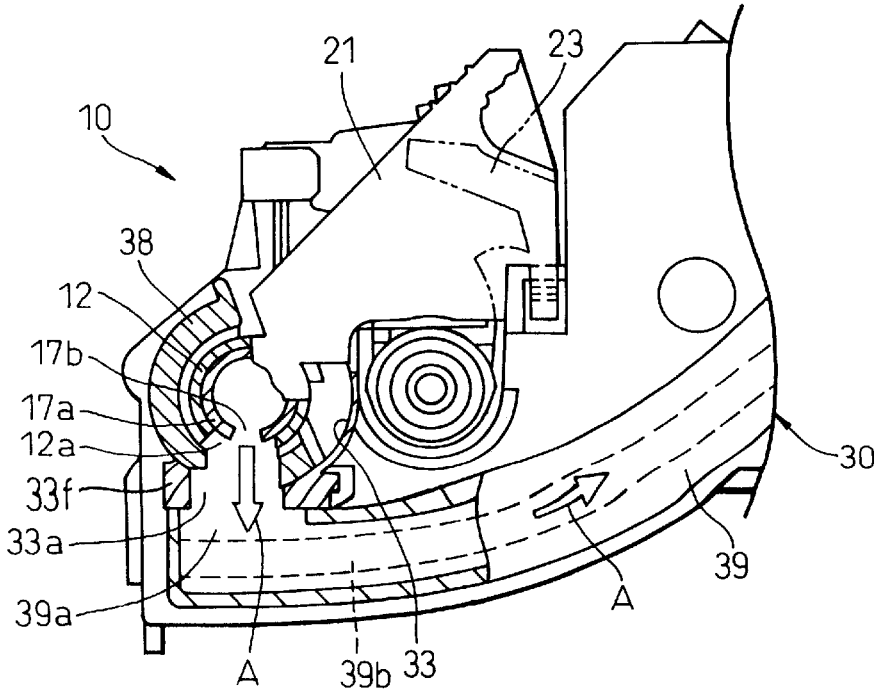
FIG. 17B is a sectional view of a joint portion between the waste toner tank and the toner returning pipe while the engagement lever is locked.

Next, FIGS. 17A is a sectional view of a joint portion between the waste toner tank 17 and the toner returning pipe 39 in a state wherein the engagement lever 21 is not locked. FIG. 17B is a sectional view of a joint portion between the waste toner tank 17 and the toner returning pipe 39 in a state wherein the engagement lever 21 is locked. The operation of the engagement lever 21, the toner returning cylinder 12, the shutter 38 and the toner returning pipe 39 is the same as that described with reference to FIGS. 8A and 8B. The engagement lever 21 has the guide groove 23, the operation of which has been already described.

Figure 18:
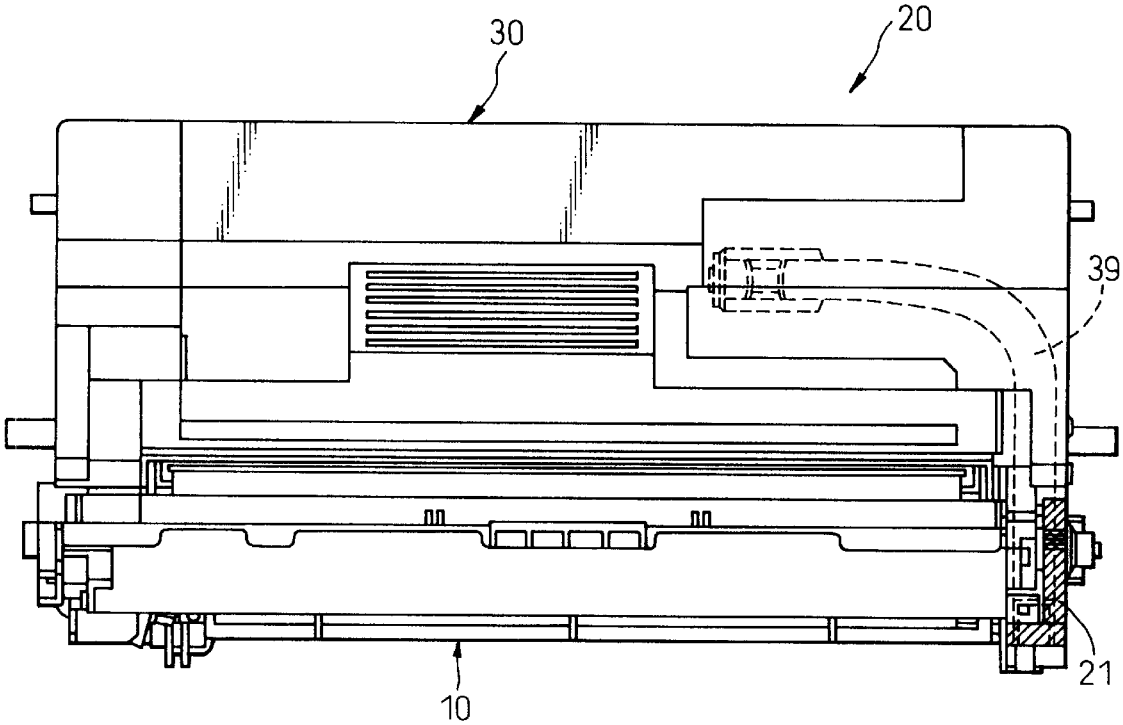
FIG. 18 is a top view of the image forming unit.

FIG. 18 is a plan view of the image forming unit 20. The toner returning pipe 39 is arranged along the right side of the image forming unit 20, which is the side locked by the engagement lever 21, and bends leftward so that the toner returns again in the rear portion of the developing unit 30 to the toner chamber 2*a* through the toner returning port 2*c* present at the end thereof.

Figure 19:
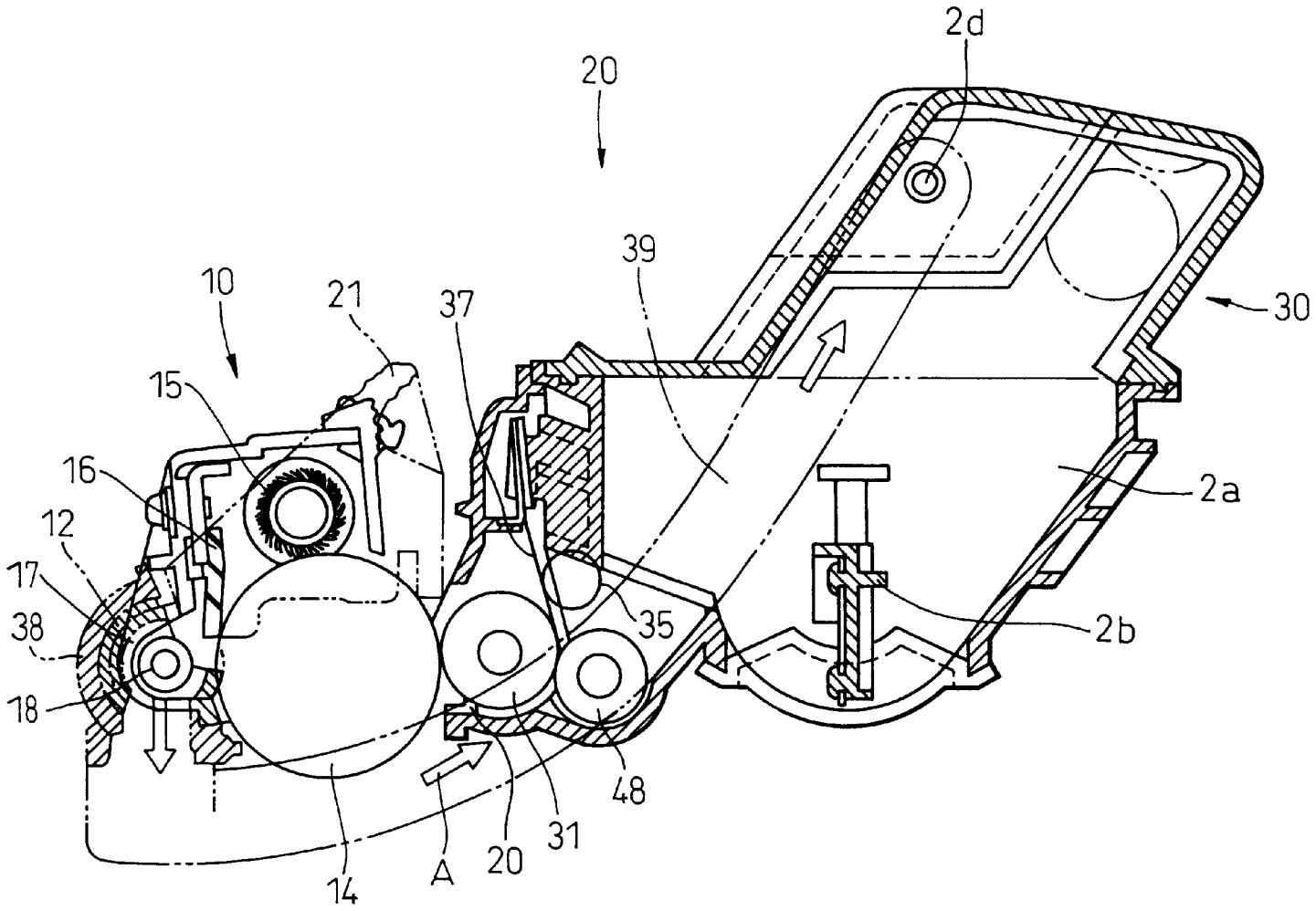
FIG. 19 is a sectional view of the image forming unit while the engagement lever is locked.
Figure 20:
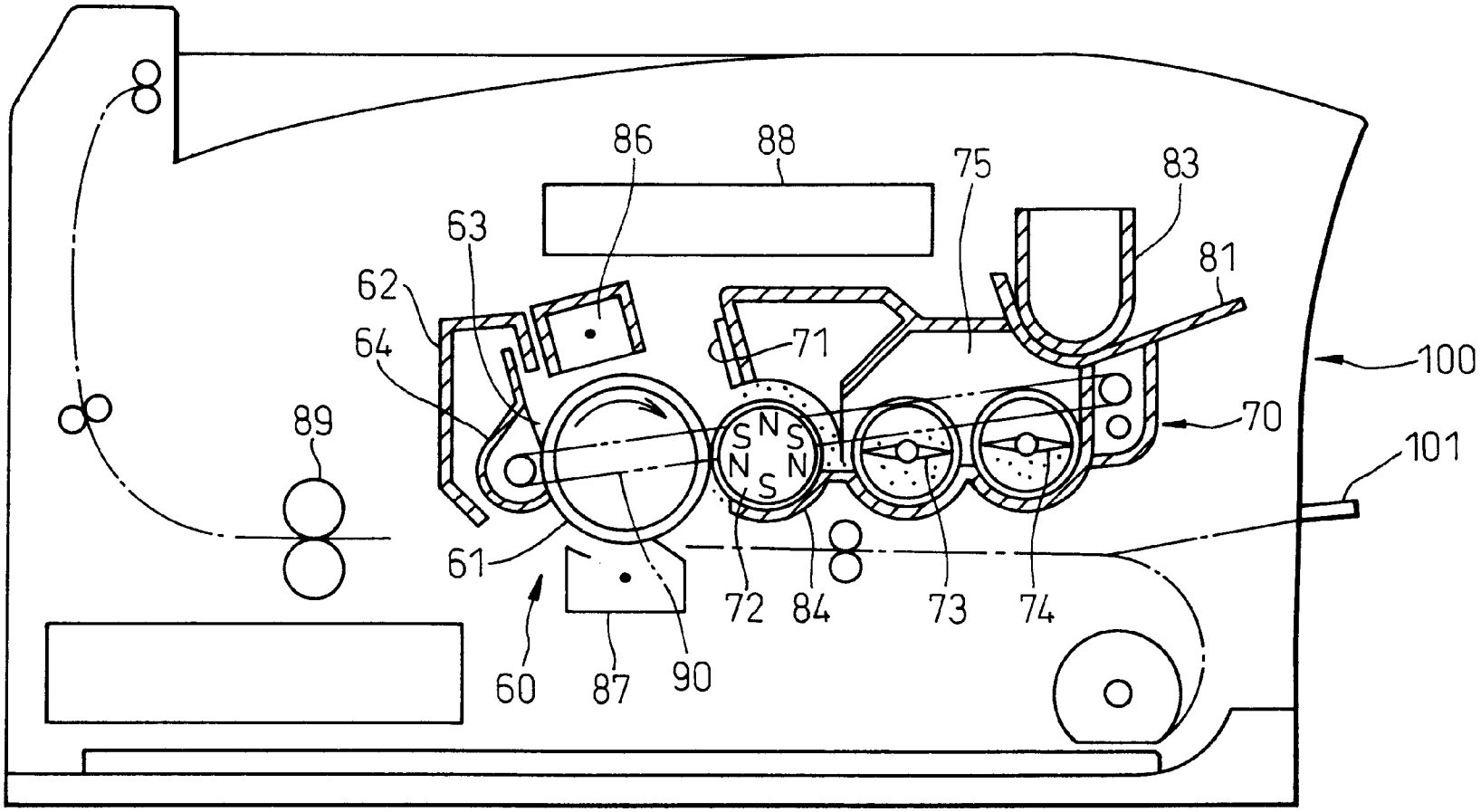
FIG. 20 is a view showing a prior art.
Figure 21:
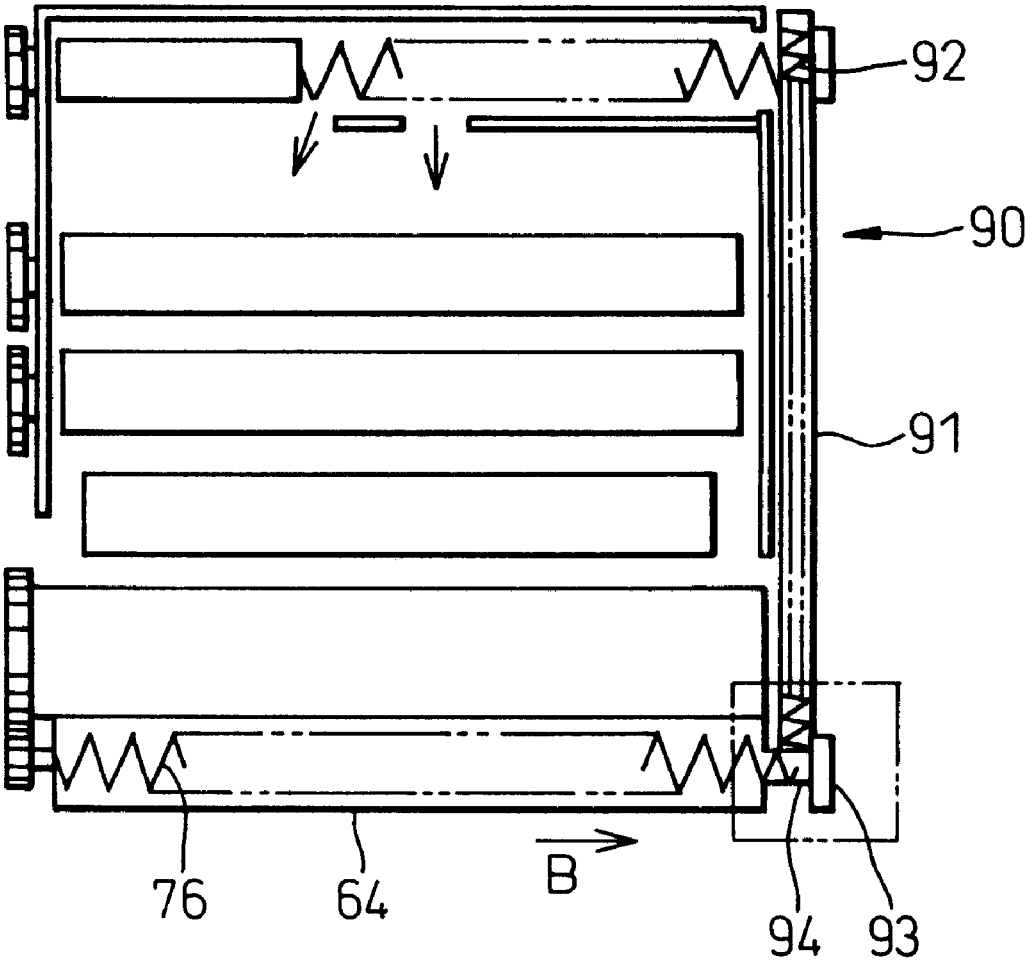
FIG. 21 is a view showing the prior art.

FIG. 19 is a sectional view of the image forming unit 20 when the engagement lever 21 is locked. It is possible to maintain the developing roller 31 assuredly in contact with the photosensitive drum 14 by the engagement between the engagement lever 21 and the boss 43 of the slide lever 41, the engagement between the boss 42 of the photosensitive drum and the engagement groove 44 of the developing unit 30, the pressure caused by the abutment between the projections 25 and 45, and the displacement of the developing unit 30 about the developing unit rotary shafts 35 due to the torque of the developing unit drive gear 46.

As described above, according to the third embodiment of the present invention, similar to the first and second embodiments, it is possible for the user to replace the photosensitive drum unit and the developing unit independently of each other because the toner returning mechanism is divided into a photosensitive drum unit section and the developing unit section.

Also, since a mechanism is provided for pressing the developing roller onto the photosensitive drum following a mounting movement when the photosensitive drum unit is mounted to the developing unit, within the image forming unit, which mechanism facilitates the engagement between the engagement lever 21 and the boss 43 of the slide lever 41 and the engagement between the boss 24 of the photosensitive drum unit and the engagement groove 44 of the developing unit 30, it is possible to cause the developing roller to be assuredly in contact with the photosensitive drum irrespective of the positional accuracy of the supporting mechanism for the image forming unit provided in the main body of the image forming apparatus, whereby the generation of printing defects such as blurring is avoidable.

Also, since a mechanism is provided for pressing the developing roller onto the photosensitive drum during the image formation, including a mechanism for causing the abutment between the projections 25 and 45 and a mechanism for displacing the developing unit 30 about the developing unit rotating shaft 35 due to the torque of the developing unit drive gear 46, the abutment becomes more stable, whereby the generation of printing defects such as blurring is more reliably avoidable.

While the present invention has been described with reference to the preferred embodiments as described above, the present invention should not be limited thereto but may be variously changed or modified without departing from the spirit of the present invention. For example, although the embodiment has been explained on the contact developing system while using a non-magnetic toner of a single component type, it is applicable also to a non-contact developing system or a jumping developing system, or to a magnetic toner of a two-component type.

Also it is unnecessary to provide all of the three pressing mechanisms; i.e., the engagement mechanism between the engagement lever 21 and the boss 43 of the slide lever 41, the engagement mechanism between the boss 24 of the photosensitive drum unit and the engagement groove 44 of the developing unit 30, the mechanism for causing the abutment between the projections 25 and 45, and the displacement mechanism of the developing unit 30 about the developing unit rotating shaft 35 due to the torque of the developing unit drive gear 46; but at least one of them may be provided.

As described hereinbefore, according to the present invention, it is possible for the user to replace the photosensitive drum unit and the developing unit separately from each other, since the mechanism is provided for dividing the toner returning mechanism into the photosensitive drum unit side section and the developing unit side section, to reduce the running cost of the image forming apparatus to a large extent.

Also, according to the present invention, since the mechanism for pressing the developing roller onto the photosensitive drum is provided in the image forming unit, it is possible to assuredly cause the developing roller to abut against the photosensitive drum irrespective of the positional accuracy of the image forming unit supporting mechanism of the main body of the image forming apparatus, whereby the generation of the printing trouble such as blurring is avoidable to largely contribute to the high printing quality of the image forming apparatus.

What is claimed is:

1. An image forming unit comprising:

a latent image carrier unit and a developing unit detachably mounted to each other;

the latent image carrier unit rotatably mounting a photosensitive member and having a waste toner receptacle;

the developing unit having a developing roller and a toner returning mechanism;

said developing unit having a support portion for supporting the latent image carrier unit; and said support portion having a part of said toner returning mechanism defined therein such that the waste toner receptacle is engaged with the toner returning mechanism when the latent image carrier unit is placed on the support portion of the developing unit.

2. An image forming unit according to claim 1, wherein said waste toner receptacle has a waste toner outlet and a first shutter for opening and closing said waste toner outlet, and said part of said toner returning mechanism has a waste toner inlet and a second shutter for opening and closing said waste toner inlet.

3. An image forming unit according to claim 2, wherein said latent image carrier unit has a lever to move said first shutter.

4. An image forming unit according to claim 3, wherein said lever can also move said second shutter.

5. An image forming unit according to claim 1, wherein said support portion comprises a first arm portion provided on one side of said developing unit with a through-hole to receive one end of a shaft of said latent image carrier unit and a second arm portion provided on the other side of the said developing unit with a semi-circular groove to receive the other end of said shaft, said part of said toner returning mechanism being provided in one of said first and second arms.

6. An image forming unit comprising:

a latent image carrier unit and a developing unit detachably mounted to each other;

the latent image carrier unit having a latent image carrier rotatably mounting a photosensitive member;

the developing unit having a developing roller and a shaft extending parallel to said developing roller, said developing unit being rotatable about said shaft; and a pressing device for pressing the developing roller onto the photosensitive member, said pressing device comprising a first member provided on said latent image carrier unit and a second member provided on said developing unit such that said first member can engage with said second member when said photosensitive member is driven for rotation, whereby said developing unit is rotated about said shaft by said latent image carrier unit via said first and second members to thereby cause said developing roller to be pressed onto the photosensitive member.

7. An image forming unit according to claim 2, wherein said pressing device further comprises a lever provided on the latent image carrier unit and operatively coupled to said developing unit.

8. An image forming unit according to claim 7, wherein said pressing device further comprises a rotating mechanism causing the developing unit to be rotated by a drive force derived from a main body of an image forming apparatus.

9. An image forming unit according to claim 7, wherein the lever opening/closing mechanism comprises an engagement lever engageable with a slide lever connected to a spring member provided in the developing unit.

10. An image forming unit according to claim 9, wherein a projection is provided in the latent image carrier unit to be engaged with a groove provided in a side wall of the developing unit so that a force for pressing the developing onto the photosensitive member is generated due to the movement of the lever.

11. An image forming unit according to claim 7, wherein said latent image carrier unit further includes a waste toner receptacle having a waste toner outlet and a first shutter for opening and closing said waste toner outlet, and said developing unit further includes a toner returning mechanism having a waste toner inlet and a second shutter for opening and closing said waste toner inlet, said waste toner receptacle being engaged with the toner returning mechanism when the latent image carrier unit is attached to said developing unit, and wherein said lever can also move at least one of said first and second shutters.

12. An image forming unit according to claim 2, wherein said latent image carrier unit further includes a cleaning blade in frictional contact with said photosensitive member whereby said latent image carrier unit is rotated along with said photosensitive member.

13. A latent image carrier unit adapted to be detachably mounted to a developing unit having a developing roller, said latent image carrier unit comprising:

a frame;

a photosensitive member rotatably arranged in said frame; and a projection provided on said frame such that said projection can engage with a corresponding projection provided on the developing unit when said photosensitive member is driven for rotation, whereby said developing unit is rotated about a shaft thereof by said latent image carrier unit via said projections to thereby cause said developing roller to be pressed onto the photosensitive member.

14. latent image carrier unit according to claim 13, further comprising:

a waste toner receptacle having a waste toner outlet and a shutter for opening and closing said waste toner outlet; and a lever to move said shutter, said lever being adapted to be operatively coupled to the developing unit.

15. A latent image carrier unit according to claim 14, further comprising a projection engageable with a groove provided in a side wall of the developing unit so that a torque for pressing the developing roller onto the photosensitive member is generated due to the movement of the lever.

16. A developing unit adapted to be detachably mounted to a latent image carrier unit having a photosensitive member, said developing unit comprising:

a frame;

a developing roller rotatably arranged in said frame;

a shaft extending parallel to said developing roller, said developing unit being rotatable about said shaft; and a projection provided on said frame such that said projection can engage with a corresponding projection provided on the latent image carrier unit when said photosensitive member is driven for rotation, whereby said developing unit is rotated about said shaft by said latent image carrier unit via said projections to thereby cause said developing roller to be pressed onto the photosensitive member.

17. A developing unit according to claim 16, further comprising a spring and a slide lever arranged between said lever and said spring.

18. A developing unit according to claim 17, further comprising a groove provided in a side wall of the developing unit engageable with a projection provided on the latent image carrier unit so that a torque for pressing the developing roller onto the photosensitive member is generated due to the movement of the lever.

19. An image forming apparatus comprising:

an image forming unit including a latent image carrier unit and a developing unit detachably mounted to each other;

the latent image carrier unit rotatably mounting a photosensitive member and having a waste toner receptacle, the developing unit having a developing roller and a toner returning mechanism;

said developing unit having a support portion for supporting the latent image carrier unit; and said support portion having a part of said toner returning mechanism defined therein such that the waste toner receptacle is engaged with the toner returning mechanism when the latent image carrier unit is placed on the support portion of the developing unit.

20. An image forming apparatus comprising:

an image forming unit including a latent image carrier unit and a developing unit detachably mounted to each other;

the latent image carrier unit rotatably mounting a photosensitive member;

the developing unit having a developing roller and a shaft extending parallel to said developing roller, said developing unit being rotatable about said shaft; and a pressing device for pressing the developing roller onto the photosensitive member, said pressing device comprising a first member provided on said latent image carrier unit and a second member provided on said developing unit such that said first member can engage with said second member when said photosensitive member is driven for rotation, whereby said developing unit is rotated about said shaft by said latent image carrier unit via said first and second members to thereby cause said developing roller to be pressed onto the photosensitive member.

21. An image forming apparatus according to claim 20, wherein said pressing device further comprises a lever provided on the latent image carrier unit and being operatively coupled to said developing unit.

22. An image forming apparatus according to claim 21, wherein said pressing device further comprises a rotating mechanism causing the developing unit to be rotated by a drive force derived from a main body of said image forming apparatus.

23. An image forming apparatus according to claim 21, wherein the latent image carrier unit further includes a waste toner receptacle having a waste toner outlet and a first shutter for opening and closing said waste toner outlet, and said developing unit further includes a toner returning mechanism having a waste toner inlet and a second shutter for opening and closing said waste toner inlet, said waste toner receptacle being engaged with the toner returning mechanism when the latent image carrier unit is attached to said developing unit, and wherein said lever can also move at least one of said first and second shutters.

24. An image forming apparatus according to claim 20, wherein said latent image carrier unit further includes a cleaning blade in frictional contact with said photosensitive member whereby said latent image carrier unit is rotated along with said photosensitive member.

* * * * *